United States Patent [19]

Fukagai et al.

[11] Patent Number: 4,830,942

[45] Date of Patent: May 16, 1989

[54] ELECTROPHOTOGRAPHIC PHOTOCONDUCTOR

[75] Inventors: Toshio Fukagai, Shizuoka; Michio Kimura, Numazu; Masafumi Ohta, Susono; Mitsuru Hashimoto, Numazu, all of Japan

[73] Assignee: Ricoh Company Ltd., Tokyo, Japan

[21] Appl. No.: 53,755

[22] Filed: May 26, 1987

[30] Foreign Application Priority Data

May 26, 1986 [JP] Japan ..... 61-119269
May 26, 1986 [JP] Japan ..... 61-119272
May 26, 1986 [JP] Japan ..... 61-119271

[51] Int. Cl.[4] ..... G03G 5/14

[52] U.S. Cl. ..... 430/58; 430/72; 430/76

[58] Field of Search ..... 430/64, 58, 72, 76

[56] References Cited

U.S. PATENT DOCUMENTS 4,363,859 12/1982 Sasaki et al. ..... 30/64 X

*Primary Examiner*—J. David Welsh
*Attorney, Agent, or Firm*—Oblon, Fisher, Spivak, McClelland & Maier

[57] ABSTRACT

An electrophotographic photoconductor an electroconductive substrate, an intermediate layer comprising a charge generating azo pigment and a thermosetting resin, a charge generating layer and a charge transporting layer, which layers are successively overlaid on the electroconductive substrate, the charge generating azo pigment being any of the azo pigments (1) through (4):

Azo pigment (1): (I)

Azo pigment (2): (II)

Azo pigment (3): (III)

15 Claims, 1 Drawing Sheet

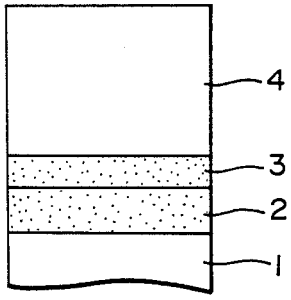
4
3
2
1

ELECTROPHOTOGRAPHIC PHOTOCONDUCTOR

BACKGROUND OF THE INVENTION

The present invention relates to an electrophotographic photoconductor with minimized variations in the electric properties thereof by the ambient conditions, which comprises an electroconductive substrate, an intermediate layer, a charge generating layer and a charge transporting layer, which layers are successively overlaid on the electroconductive substrate.

Conventionally, a variety of methods have been proposed and tried for the purposes of increasing the photosensitivities and minimizing the residual potential of electrophotographic photoconductors comprising a charge generating layer and a charge transporting layer which are successively overlaid on an electroconductive substrate.

For instance, there has been proposed a method of interposing an intermediate layer between the electroconductive substrate and the charge generating layer of an electrophotographic photoconductor for preventing the electric charge having a polarity opposite to that of the electric charge applied to the electrophotographic photoconductor for image formation from being injected from the electroconductive substrate to the charge generating layer during the application of the electric charge for image formation.

Specifically, intermediate layers comprising cellulose nitrate are proposed in Japanese Laid-Open Patent Application Nos. 47-6341, 48-3544 and 48-12034; intermediate layers comprising a nylon resin in Japanese Laid-Open Patent Application Nos. 48-47344, 52-25638, 58-30757, 58-63945, 58-95351, 58-98739 and 60-66258; an intermediate layer comprising a vinyl acetate resin in Japanese Laid-Open Patent Application No. 48-26141; intermediate layers comprising a maleic acid resin in Japanese Laid-Open Patent Application Nos. 49-69332 and 52-10138; and an intermediate layer comprising a polyvinyl alcohol resin in Japanese Laid-Open Patent Application No. 53-100240.

Further in order to control the electric resistivity of such intermediate layers, a variety of electroconductive additives to be contained in the intermediate layers have been proposed. For example, an intermediate layer comprising carbon or a chalcogen type material which is dispersed in a setting type resin is proposed in Japanese Laid-Open Patent Application No. 51-65942; an intermediate layer comprising a polymer which is thermally polymerized using an isocyanate type setting agent with addition thereto of a quaternary ammonium salt; an intermediate layer comprising a resin with addition thereto of an electric resistivity adjustment agent in Japanese Laid-Open Patent Application No. 55-1180451; an intermediate layer comprising a resin in which aluminum oxide or tin oxide is dispersed in Japanese Laid-Open Patent Application No. 58-58556; an intermediate layer comprising a resin in which an organometallic compound is dispersed in Japanese Laid-Open Patent Application No. 58-93062; intermediate layers comprising a resin in which electroconductive particles are dispersed in Japanese Laid-Open Patent Application Nos. 58-93063, 60-97363 and 60-111255; and intermediate layers comprising a resin in which $TiO_2$ and $SnO_2$ powders are dispersed in Japanese Laid-Open Patent Application Nos. 59-84257, 59-93453 and 60-32054.

Further, in order to control the charge transfer in the intermediate layer instead of the electric resistivity of the intermediate layer, there have been proposed intermediate layers comprising a resin in which an electron-accepting organic compound serving as a negative charge transporting material is dispersed.

For instance, an intermediate layer comprising an organic photoconductive polymer with addition thereto of a polycyclic aromatic nitro compound is proposed in Japanese Laid-Open Patent Application No. 53-89433; and intermediate layers comprising a resin containing therein an elctron-accepting organic material in Japanese Laid-Open Patent Application Nos. 54-4134, 59-160147 and 59-170846.

Furthermore, Japanese Laid-Open Patent Application No. 59-65852 discloses a photoconductor comprising an electroconductive substrate, a first charge generating layer containing a selenium compound having high photosensitivity to short-wavelength light, a second charge generating layer in which an organic pigment having high photosensitivity to long-wavelength light (such as a phthalocyanine type pigment, a squarylium type pigment and a cyanine type pigment) is dispersed, and an organic charge transporting layer, which layers are successively overlaid on the electroconductive substrate.

However, the first mentioned photoconductors having intermediate layers consisting of only resins are prepared so as to obtain high chargeability and low residual potential by controlling the electric resistivity of the intermediate layers. In those intermediate layers, insulating resins having relatively low resistivities ranging from $10^{10}$ Ωcm to $10^{14}$ Ωcm are employed. In order to increase the chargeability of the photoconductors, it is necessary to increase the thickness of the intermediate layers, while in order to reduce the residual potential of the photoconductors after exposure to light, it is necessary to decrease the thickness of the intermediate layers. Therefore it is extremely difficult to obtain both high chargeability and low residual potential at the same time by using these intermediate layers. Further, these intermediate layers are susceptible to the water contained in the air, so that at low temperatures and high humidities, the photoconductors having these intermediate layers tend to have high chargeability and high residual potential, while at high temperatures and high humidities, they tend to have low chargeability and low residual potential. In short, those photoconductors have the shortcoming that their electric properties are considerably susceptible to the changes in the ambient conditions.

In the photoconductors having an intermediate layer of the type comprising a resin and an electroconductive additive, the electric resistivity of the intermedate layer is controlled by the electroconductive additive. However, as in the case of the intermediate layer consisting of only a resin, the electric resistivity of the intermediate layer has a significant effect on the electric characteristics of the photoconductor. This intermediate layer has the same problem as in the case of the intermediate layer consisting of only a resin. Furthermore, the electroconductive additive contained is susceptible to the water contained in the air, so that it is still very difficult to meet the requirements for high chargeability and low residual potential by use of such intermediate layer.

In the photoconductors having an intermediate layer comprising a resin and an electron-accepting organic compound, the electric characteristics thereof are not so susceptible to the changes in the ambient conditions as in the above-mentioned photoconductors. However, such electron-accepting organic compounds are highly soluble in organic solvents. Therefore, the electron-accepting organic materials are apt to mix with the charge generating layer and the charge transporting layer during the coating of these layers and even during the drying thereof. When such mixing takes place, the light decay photosensitivity of the photoconductors is significantly decreased. In addition, such electron-accepting organic materials are apt to be highly crystallized and have poor compatibility with the resins to be used in combination, so that such crystallization may take place during the preparation of the photoconductors.

The previously mentioned photoconductors having an intermediate layer comprising a selenium compound and an organic pigment have the shortcoming that the process of their production is extremely complex.

SUMMARY OF THE INVENTION

It is therefore an object of the present invention to provide an electrophotographic photoconductor having high photosensitivity, high chargeability and low residual potential under the conditions of low temperatures and low humidities, and high temperatures and high humidities.

Another object of the present invention is to provide an electrophotographic photoconductor comprising photosensitive layers which can be easily formed into film layers in the course of the production thereof.

The above objects of the present invention can be achieved by an electrophotographic photoconductor comprising an electroconductive substrate, an intermediate layer comprising a charge generating azo pigment and a thermosetting resin, a charge generating layer and a charge transporting layer, which layers are successively overlaid on the electroconductive substrate.

The charge generating azo pigment is selected from the group consisting of the following azo pigments (1) through (4):

Azo pigment (1): (I)

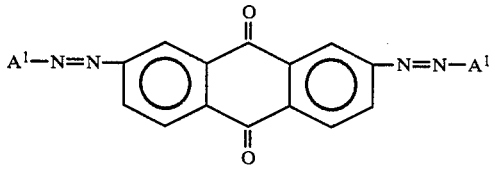

Azo pigment (2): (II)

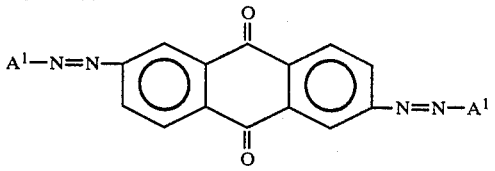

Azo pigment (3): (III)

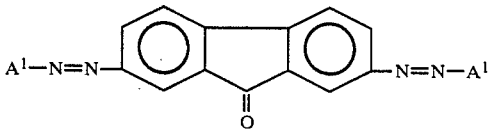

In the above formulas (I), (II) and (III), $A^1$ represents a moiety selected from the group consisting of:

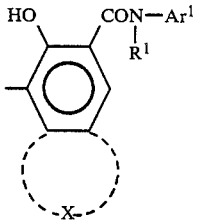

(A-1)

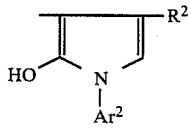

(A-2)

In the above moieties, X represents an aromatic ring such as benzene ring and naphthalene ring, or a heterocyclic ring such as indole ring, carbazole ring and benzofuran ring, which may have a substituent; $Ar^1$ represents an aromatic ring such as benzene ring and naphthalene ring, or a heterocyclic ring such as dibenzofuran ring, which may have a substituent; $Ar^2$ and $Ar^3$ each represent an aromatic ring such as benzene ring and naphthalene ring, which may have a substituent, $R^1$ and $R^3$ each represent hydrogen, a lower alkyl group, for instance, an alkyl group having 1 to 4 carbon atoms, which may have a substituent, or a phenyl group which may have a substituent; and $R^2$ represents a lower alkyl group, for instance, an alkyl group having 1 to 4 carbon atoms, a phenyl group which may have a substituent, or a carboxyl group or an ester group thereof.

Azo pigment (4): (IV)

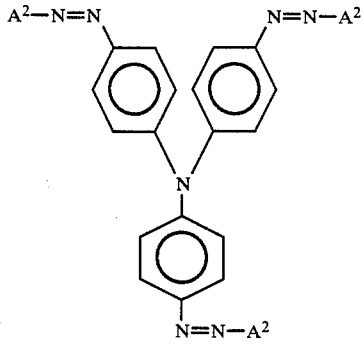

In the above formula (IV), $A^2$ represents a moiety selected from the group consisting of:

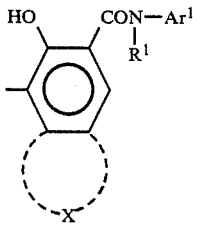

(A-1)

-continued

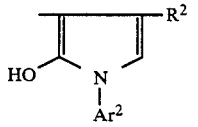

(A-2)

In the above, X, $Ar^1$, $Ar^2$, $R^1$, and $R^2$ are respectively the same as those defined in the above.

BRIEF DESCRIPTION OF THE DRAWING

The single figure shows a schematic cross-sectional view of an example of an electrophotographic photoconductor according to the present invention.

DETAILED DESCRIPTION OF THE PREFERRED EMBODIMENTS

An electrophotographic photoconductor according to the present invention comprises, for example, an electroconductive substrate 1, an intermediate layer 2, a charge generating layer 3 and a charge transporting layer 4, which layers are successively overlaid on the electroconductive substrate 1 as shown in the accompanying single figure.

The electroconductive substrate serves to supply to its side the electric charge having a polarity opposite to that of the electric charge applied to the electrophotographic photoconductor for electrostatic latent image formation. It is preferable that the electric resistivity of the electroconductive substrate be $10^8$ Ωcm or less, and be made of a material which is sufficiently durable to the formation thereon of the intermediate layer, the charge generating layer and the charge transporting layer.

Examples of such material for the electroconductive substrate are electroconductive metals such as Al, Ni, Cr, Zn and stainless steel and alloys thereof, and electroconductively treated inorganic insulating materials such as glass and ceramics, and electroconductively treated organic insulating materials such as polyester, polyimide, phenolic resin, nylon resin and paper, for example, by coating an electroconductive material such as Al, Ni, Cr, Zn, stainless steel, carbon, $SnO_2$, or $In_2O_3$ on the surface thereof by vacuum deposition, sputtering, or spraying.

The intermediate layer serves to prevent the charge injection from the electroconductive substrate to the charge generating layer at the time of charging of the photoconductor, thereby attaining stable charging of the photoconductor and transporting toward the electroconductive substrate one of a pair of electric charges generated within the charge generating layer at the time the photoconductor is exposed to light, that is, the electric charge having a polarity opposite to that of the electric charge of which injection toward the electroconductive substrate is prevented. As a matter of course, it is required that the intermediate layer perform the above-mentioned function sufficiently. In particular, in the case where the sensitivity of the charge generating layer is high, and accordingly the chargeability of the charge generating layer is not high, the intermediate layer is indispensable.

The characteristics of any intermediate layer can be assessed by measuring the chargeability, the light decay sensitivity, and the residual potential after light decay of the photoconductor including the intermediate layer.

According to the present invention, the above-mentioned characteristics required for the intermediate layer can be obtained by an intermediate layer comprising a thermosetting resin and at least one of the previously mentioned azo pigments having formulas (I), (II), (III) or (IV), which is dispersed in the thermosetting resin.

Specific examples of an azo pigment for use in the present invention are listed in Tables 1-1 and 1-2.

TABLE 1-1

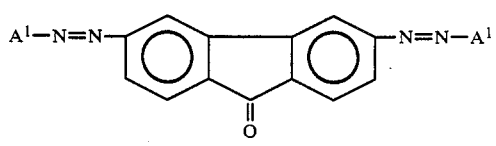

(I)

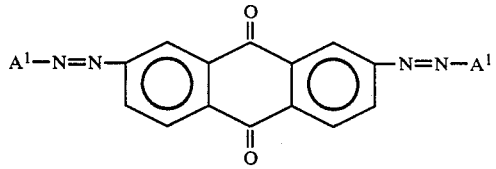

(II)

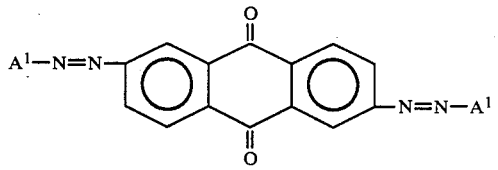

(III)

| Pigment No. | $A^1$ |
|---|---|
| I-1<br>II-1<br>III-1 | 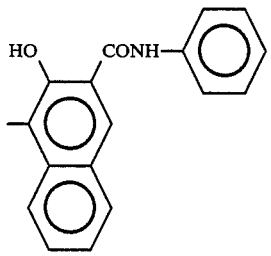 |
| I-2<br>II-2<br>III-2 | 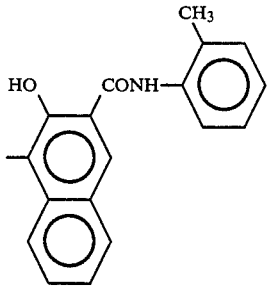 |
| I-3<br>II-3<br>III-3 | 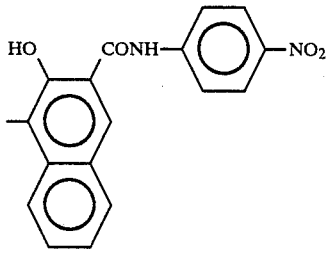 |

TABLE 1-1-continued
I-4
II-4
III-4
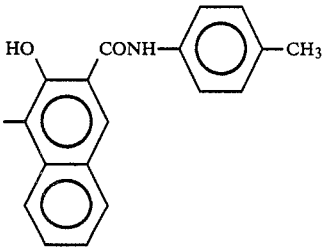
I-5
II-5
III-5
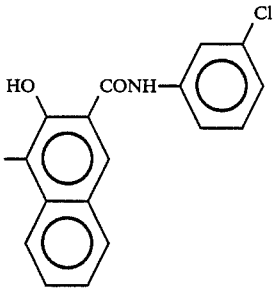
I-6
II-6
III-6
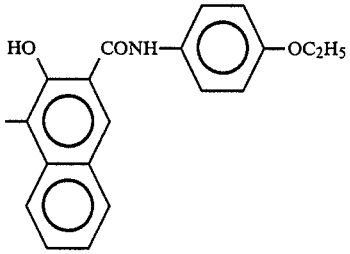
I-7
II-7
III-7
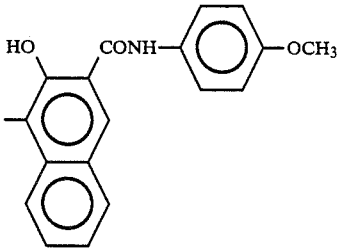
I-8
II-8
III-8
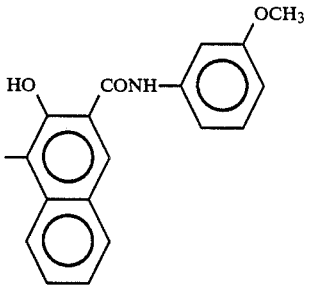
I-9
II-9
III-9
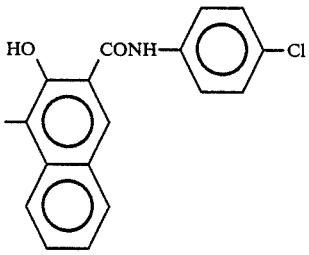
TABLE 1-1-continued
I-10
II-10
III-10
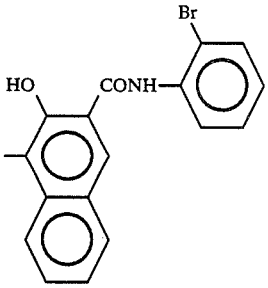
I-11
II-11
III-11
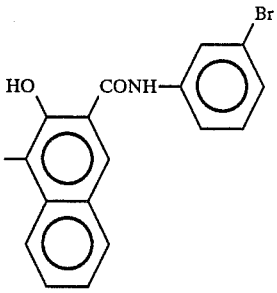
I-12
II-12
III-12
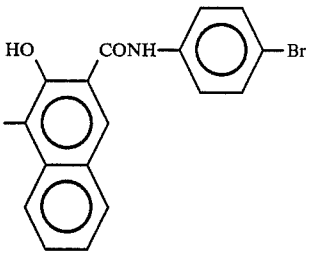
I-13
II-13
III-13
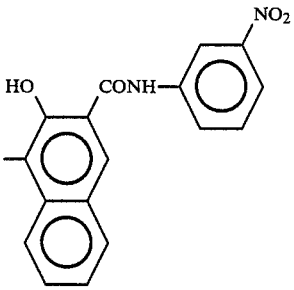
I-14
II-14
III-14
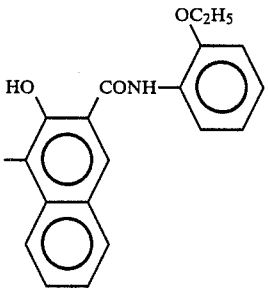

TABLE 1-1-continued
I-15
II-15
III-15
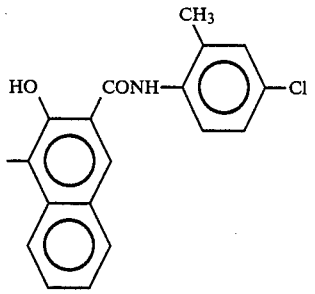
I-16
II-16
III-16
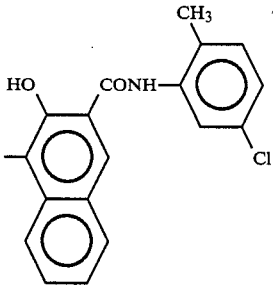
I-17
II-17
III-17
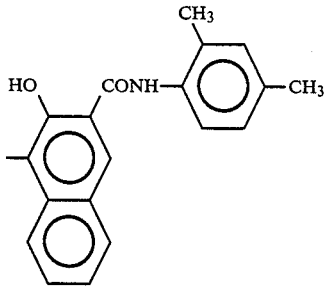
I-18
II-18
III-18
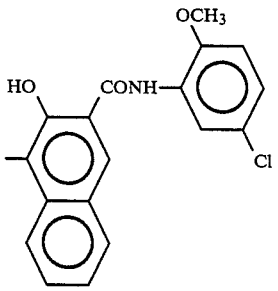
I-19
II-19
III-19
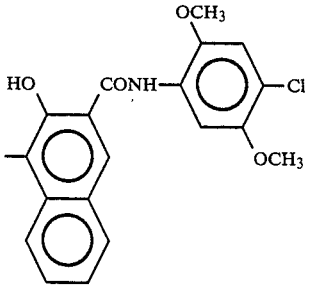
TABLE 1-1-continued
I-20
II-20
III-20
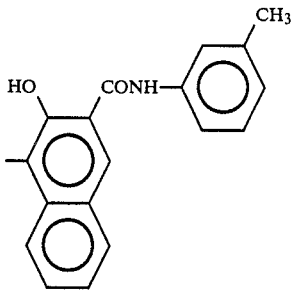
I-21
II-21
III-21
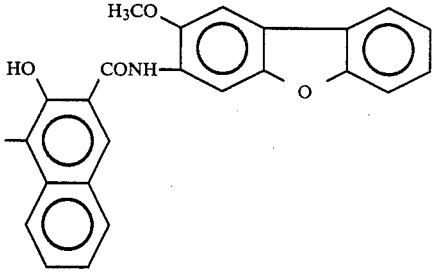
I-22
II-22
III-22
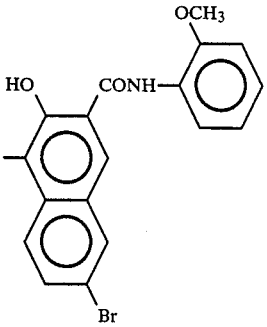
I-23
II-23
III-23
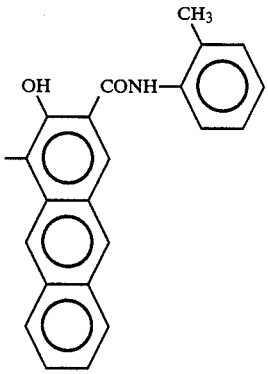
I-24
II-24
III-24
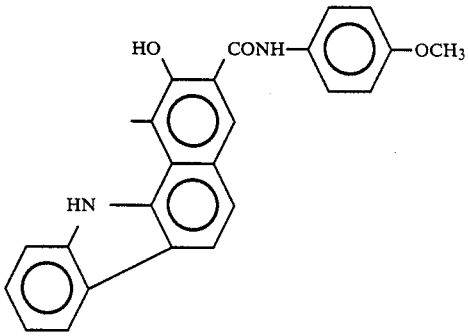

TABLE 1-1-continued
I-25
II-25
III-25
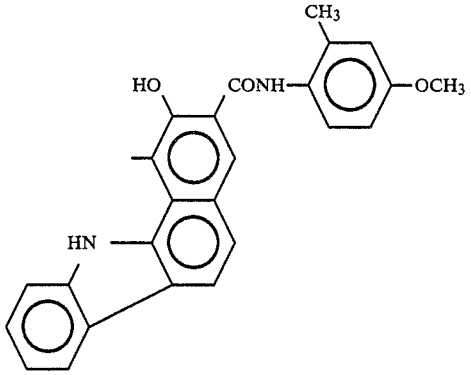
I-26
II-26
III-26
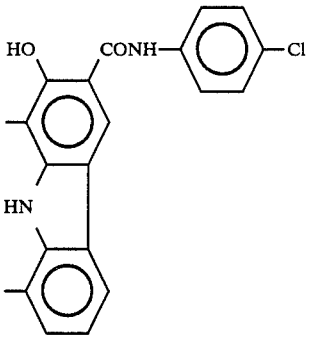
I-27
II-27
III-27
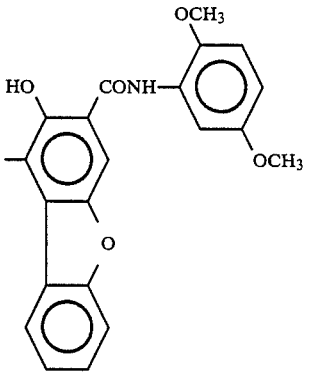
I-28
II-28
III-28
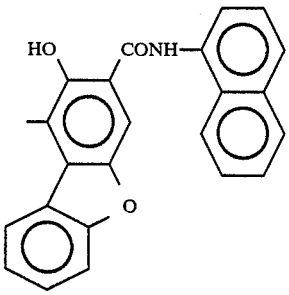
TABLE 1-2
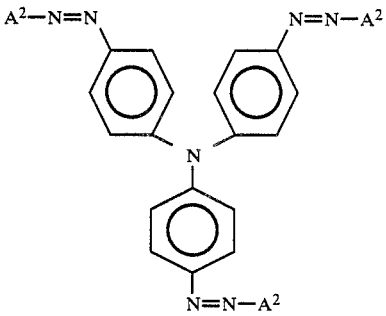
(IV)
| Pigment No. | $A^2$ |
|---|---|
| IV-1 | 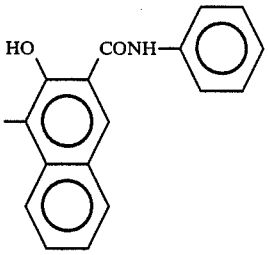 |
| IV-2 | 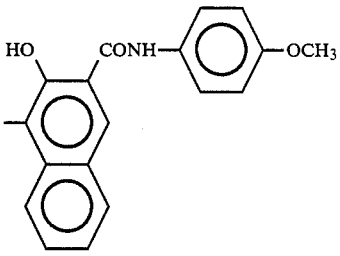 |
| IV-3 | 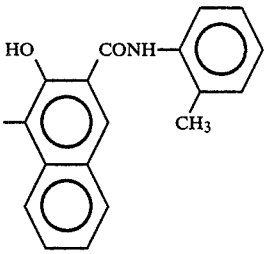 |
| IV-4 | 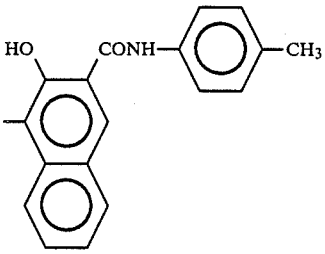 |

TABLE 1-2-continued
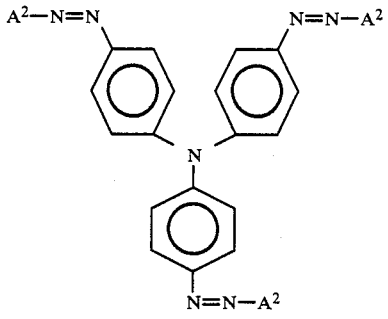
(IV)
| Pigment No. | $A^2$ |
|---|---|
| IV-5 | 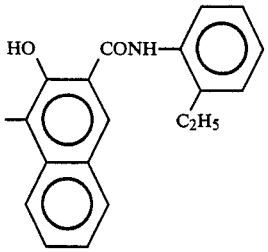 |
| IV-6 | 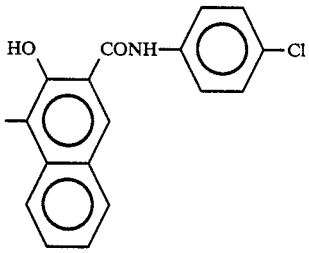 |
| IV-7 | 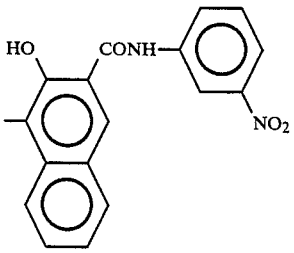 |
| IV-8 | 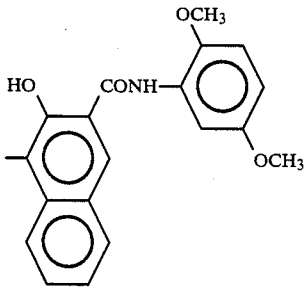 |
TABLE 1-2-continued
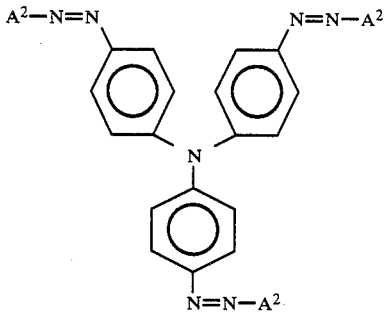
(IV)
| Pigment No. | $A^2$ |
|---|---|
| IV-9 | 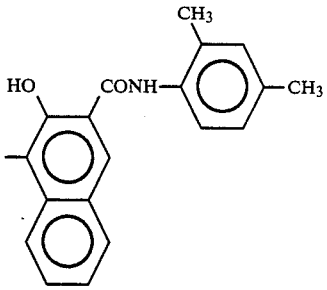 |
| IV-10 | 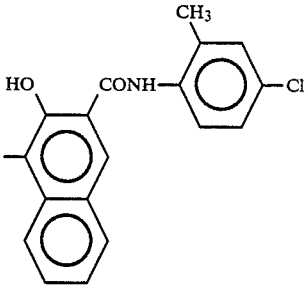 |
| IV-11 | 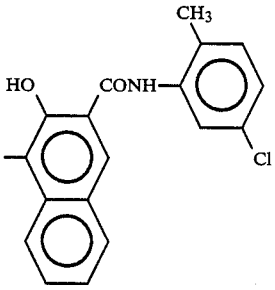 |
| IV-12 | 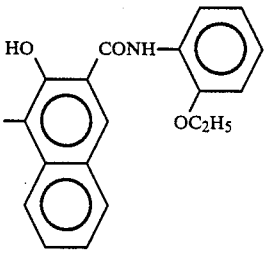 |

TABLE 1-2-continued
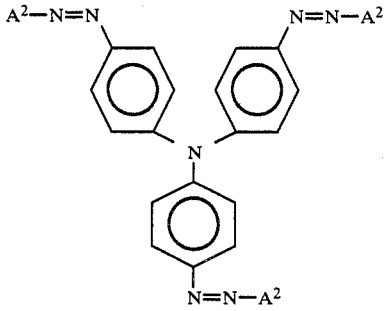
(IV)
| Pigment No. | $A^2$ |
|---|---|
| IV-13 | 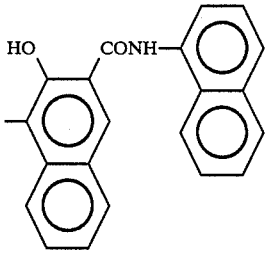 |
| IV-14 | 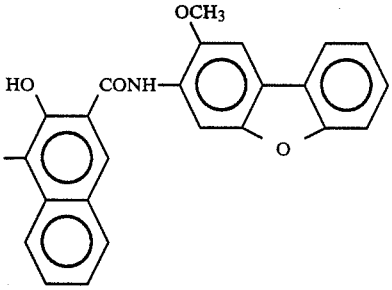 |
| IV-15 | 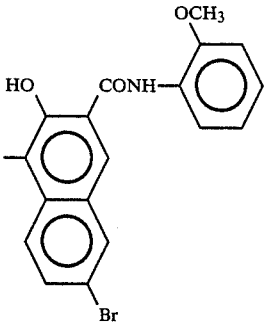 |
| IV-16 | 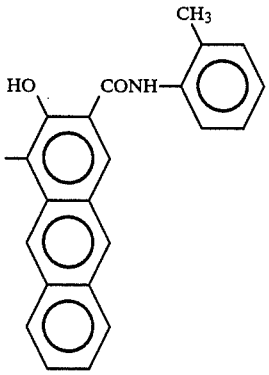 |
TABLE 1-2-continued
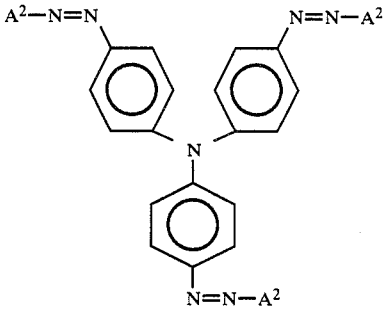
(IV)
| Pigment No. | $A^2$ |
|---|---|
| IV-17 | 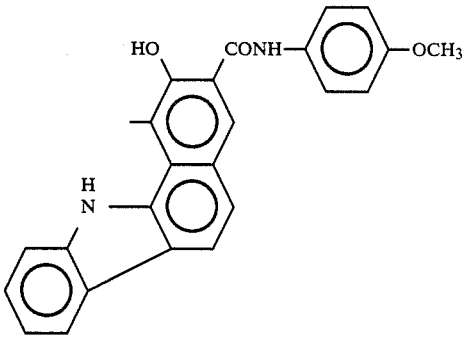 |
| IV-18 | 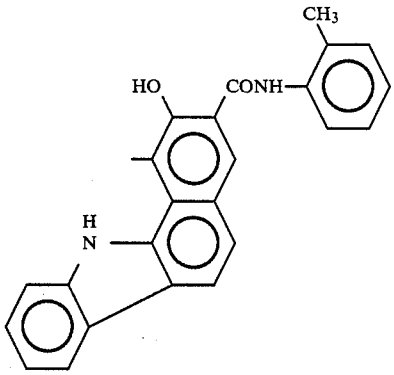 |
| IV-19 | 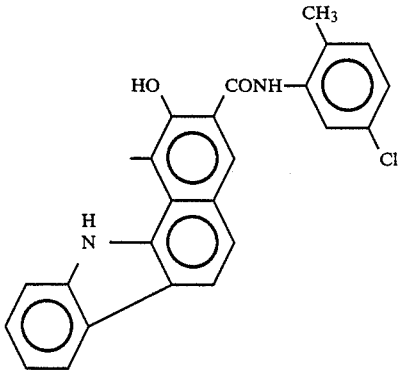 |

TABLE 1-2-continued
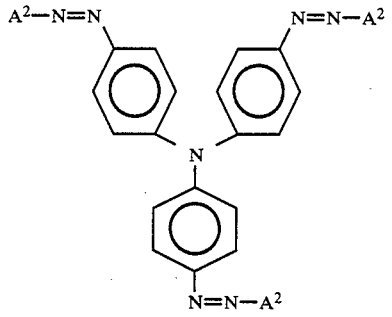
(IV)
| Pigment No. | $A^2$ |
|---|---|
| IV-20 | 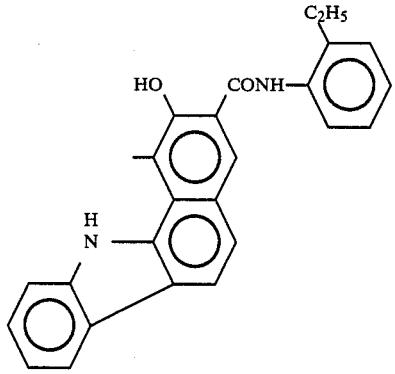 |
| IV-21 | 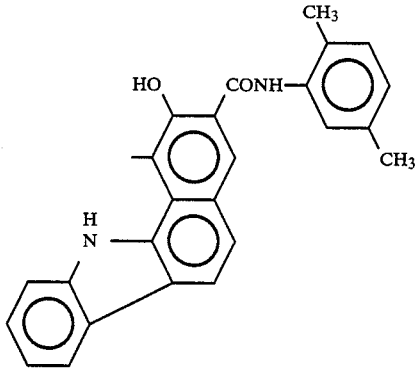 |
| IV-22 | 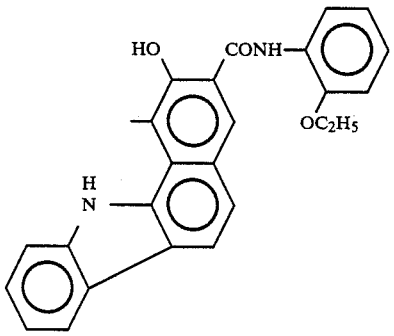 |
TABLE 1-2-continued
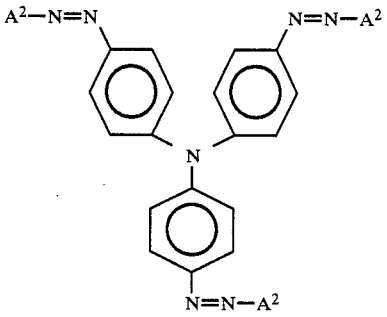
(IV)
| Pigment No. | $A^2$ |
|---|---|
| IV-23 | 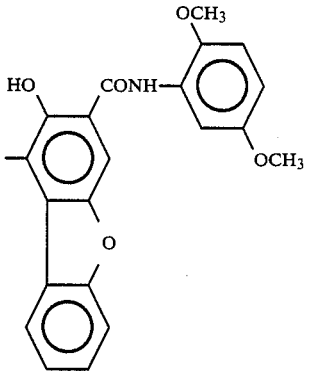 |
| IV-24 | 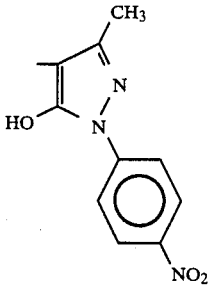 |
| IV-25 | 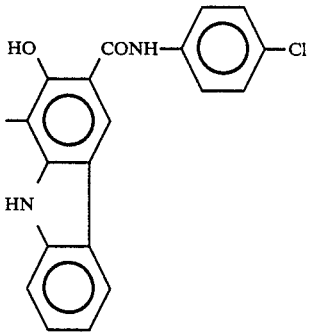 |

TABLE 1-2-continued

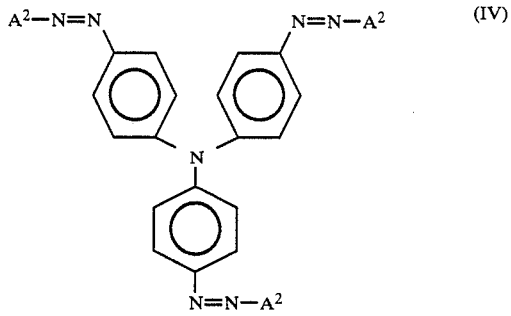

(IV)

| Pigment No. | $A^2$ |
|---|---|
| IV-26 | 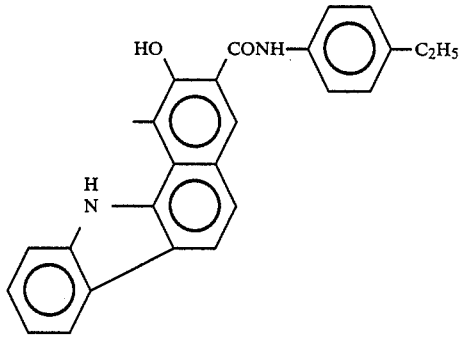 |
| IV-27 | 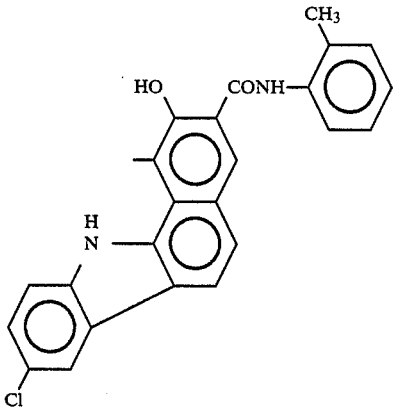 |

By use of the azo pigments having the formulas (I), (II), (III) or (IV) in the intermediate layer, in particular, high chargeability and low residual potential can be obtained even under the conditions of low temperatures and low humidities, and under the conditions of high temperatures and high humidities.

It is preferable that the content of the azo pigment be in the range of 30 wt. % to 80 wt. %, more preferably in the 40 wt. % to 70 wt. %, of the entire weight of the intermediate layer.

Examples of a thermosetting resin for use in the present invention are polymers prepared by thermal polymerization of compounds having a plurality of active hydrogens such as hydrogen of —OH group, —$NH_2$ group, —NH group and the like, and compounds having a plurality of isocyanate groups and/or compounds having a plurality of epoxy groups.

Specific examples of a compound having a plurality of active hydrogens are polyvinyl butyral, phenoxy resin, phenolic resin, polyamide, and acrylic resin such as hydroxymethyl methacrylate.

Specific examples of a compound having a plurality of isocyanate groups are tolylene diisocyanate, hexamethylene diisocyanate, diphenylmethane diisocyanate, and polymers thereof.

A specific example of a compound having a plurality of epoxy groups is Bisphenol A type epoxy resin.

In the present invention, resins which can be hardened by themselves such as phenolic resin, urea resin, melamine resin, polyester resin, polyurethane, and epoxy resin, can also be employed.

The azo pigments for use in the present invention, when used, are dispersed in the above mentioned thermosetting resins by a conventional dispersing method, for instance, using a ball mill, supersonic wave, a tree-roller sand grinder, attritor, impeller, or a stone mill.

The above dispersion is performed, for example, by dispersing the azo pigment in an organic solvent solution of a compound having a plurality of active hydrogens, and thereafter by adding to this dispersion a compound having a plurality of isocyanate groups and/or a compound having a plurality of epoxy groups. These two steps are taken in order to avoid a thermal polymerization which may be otherwise initiated by the heat generated during the dispersing process.

The intermediate layer can be formed by coating the above dispersion on an electroconductive substrate, using a conventional coating method such as the roll coating method, the immerse coating method, the spray coating method, and the blade coating method, in the form of a thin film, and then by subjecting the coated dispersion to thermal polymerization at temperatures of about 50° C. to about 200° C.

It is preferable that the thickness of the intermediate layer be in the range of 0.1 μm to 10 μm, more preferably in the range of 0.5 μm to 2 μm.

The charge generating layer serves to generate electric charges therein when the photoconductor is exposed to light and to separate the generated charges.

In the charge generating layer for use in the present invention, organic dyes and pigments, crystalline selenium particles and aresenic selenide particles can be employed as the charge generating material.

Examples of an organic pigment or dye are phthalocyanine pigments, disazo pigments, trisazo pigments, perylene pigments, squaric salt pigments, azulenium salt dyes, and quinone condensation polycyclic compounds. As such disazo pigments and trisazo pigments, the azo pigments of the formulas (I), (II), (III) and (IV) for the intermediate layer can also be employed.

Specific examples of such disazo pigments and trisazo pigments are listed in Tables 2-1, 2-2 and 203. In the general formulas (CG-1), (CG-2), (CG-3) and (CG-4), A is the same as any of the moieties (A-1), (A-2) and (A-3) defined previously in the formulas (I) through (III) of azo pigments (1) through (3).

TABLE 2-1
(CG-1)
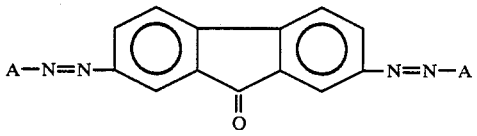
| Pigment No. | A |
|---|---|
| CG-1-1 | 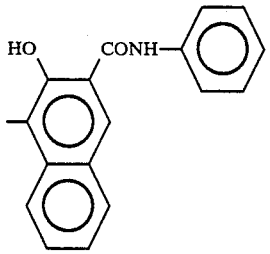 |
| CG-1-2 | 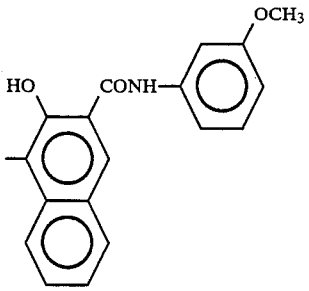 |
| CG-1-3 | 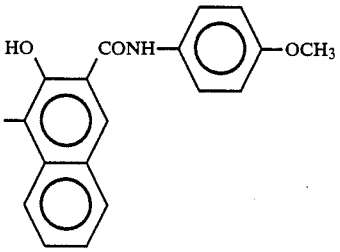 |
| CG-1-4 | 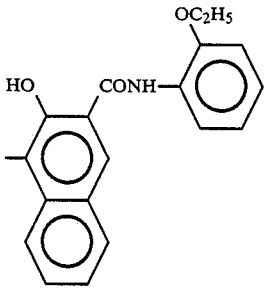 |
| CG-1-5 | 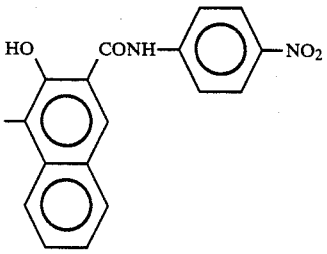 |
TABLE 2-1-continued
(CG-1)
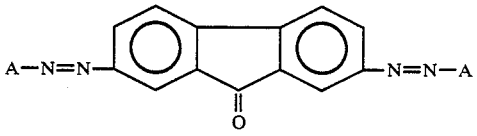
| Pigment No. | A |
|---|---|
| CG-1-6 | 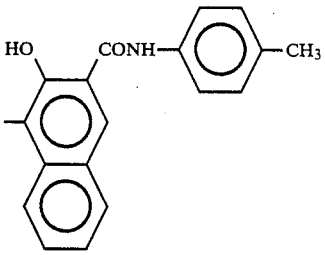 |
| CG-1-7 | 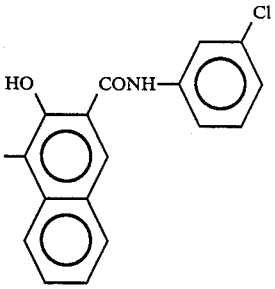 |
| CG-1-8 | 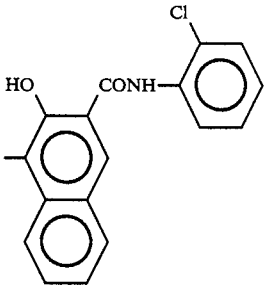 |
| CG-1-9 | 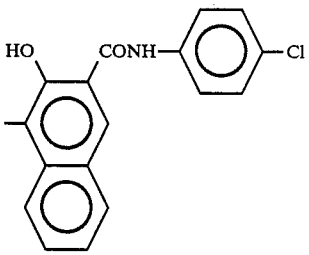 |
| CG-1-10 | 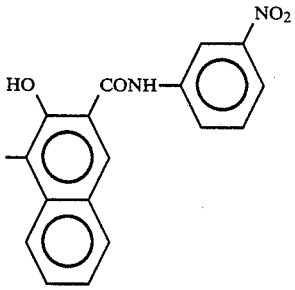 |

TABLE 2-1-continued
(CG-1)
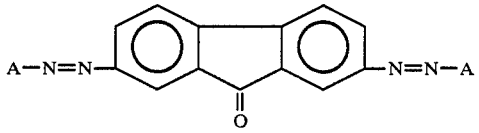
| Pigment No. | A |
|---|---|
| CG-1-11 | 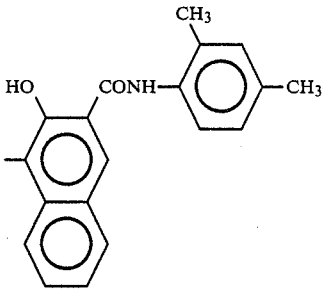 |
| CG-1-12 | 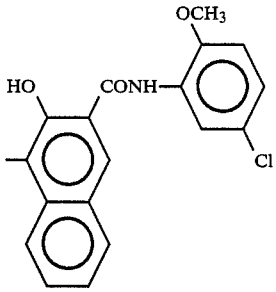 |
| G-1-13 | 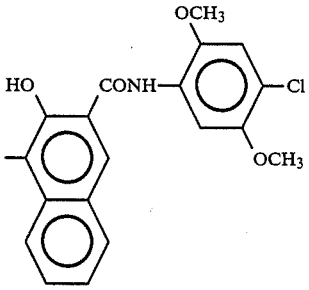 |
| CG-1-14 | 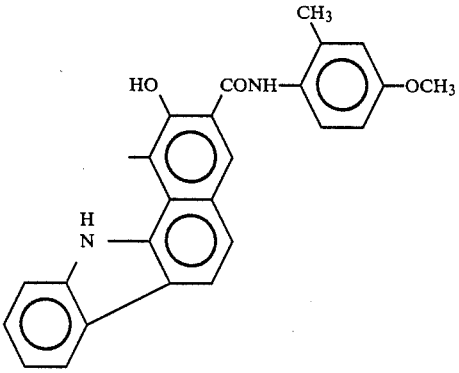 |
TABLE 2-1-continued
(CG-1)
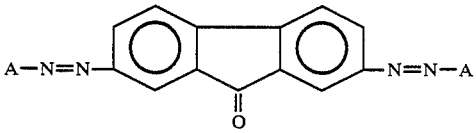
| Pigment No. | A |
|---|---|
| CG-1-15 | 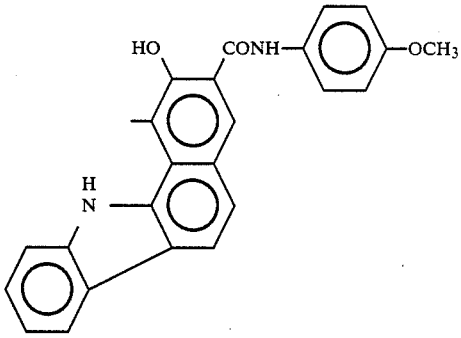 |
| CG-1-16 | 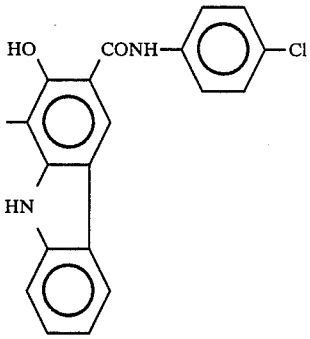 |
| CG-1-17 | 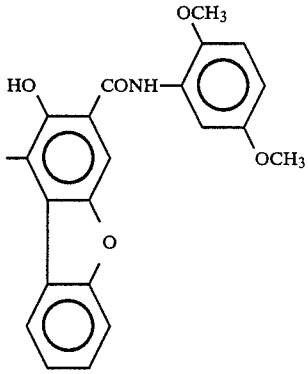 |
| CG-1-18 | 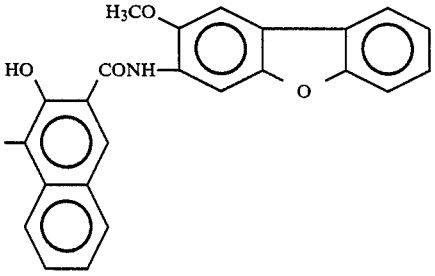 |

TABLE 2-1-continued
(CG-1)
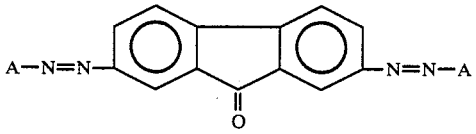
| Pigment No. | A |
|---|---|
| CG-1-19 | 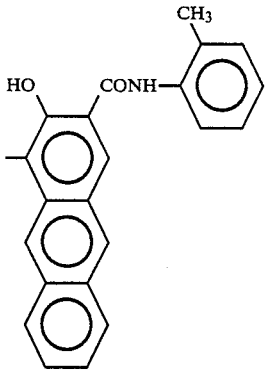 |
| CG-1-20 | 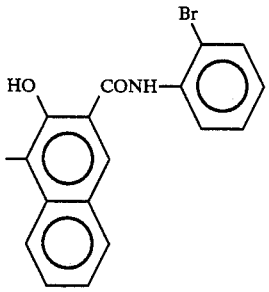 |
| CG-1-21 | 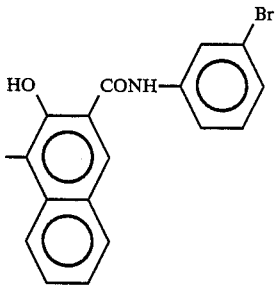 |
| CG-1-22 | 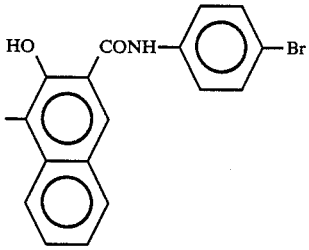 |
TABLE 2-2
(CG-2)
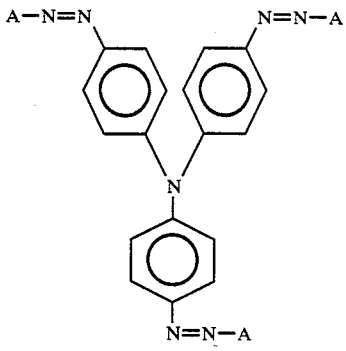
| Pigment No. | A |
|---|---|
| CG-2-1 | 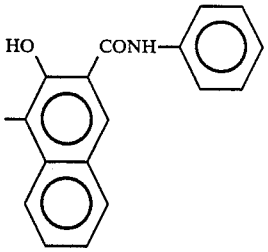 |
| CG-2-2 | 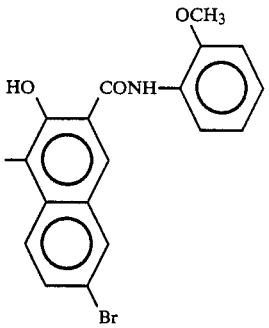 |
| CG-2-3 | 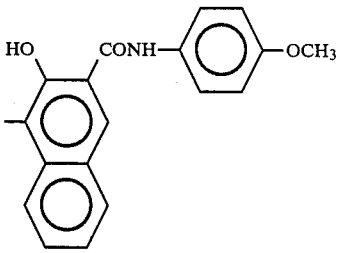 |
| CG-2-4 | 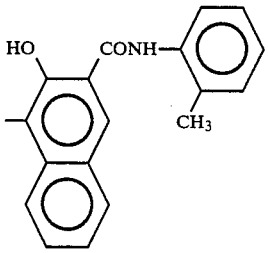 |

TABLE 2-2-continued
(CG-2)
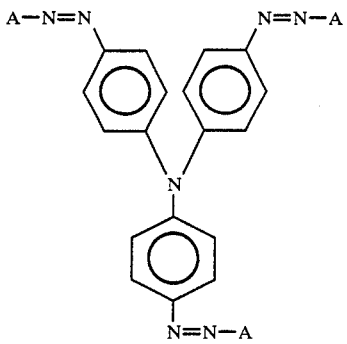
| Pigment No. | A |
|---|---|
| CG-2-5 | 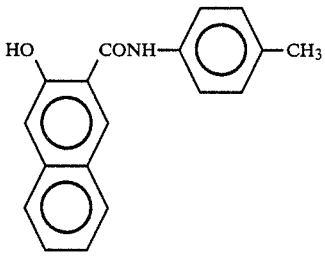 |
| CG-2-6 | 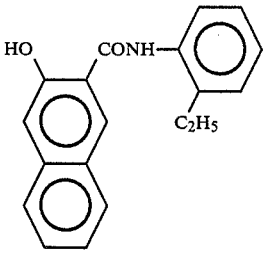 |
| CG-2-7 | 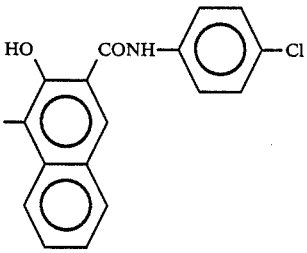 |
| CG-2-8 | 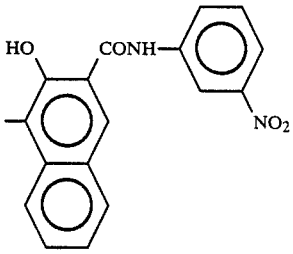 |
TABLE 2-2-continued
(CG-2)
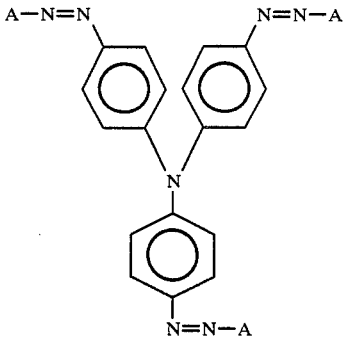
| Pigment No. | A |
|---|---|
| CG-2-9 | 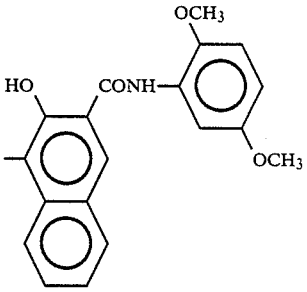 |
| CG-2-10 | 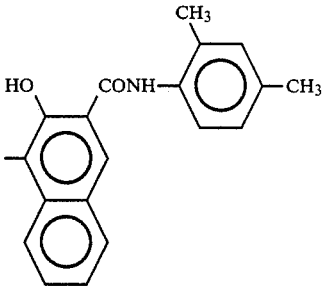 |
| CG-2-11 | 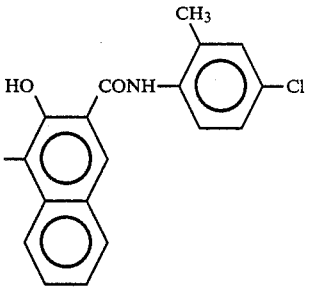 |
| CG-2-12 | 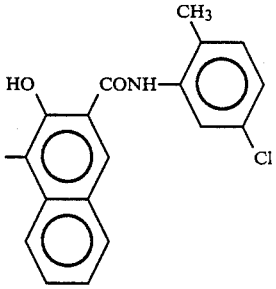 |

TABLE 2-2-continued
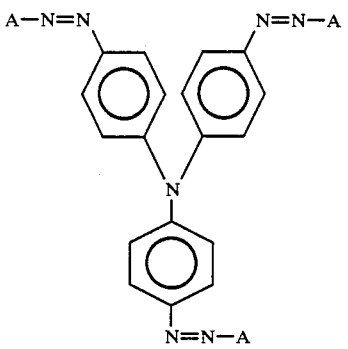
(CG-2)
| Pigment No. | A |
|---|---|
| CG-2-13 | 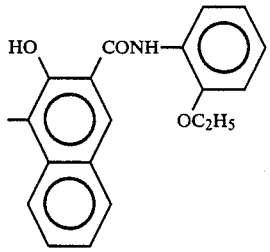 |
| CG-2-14 | 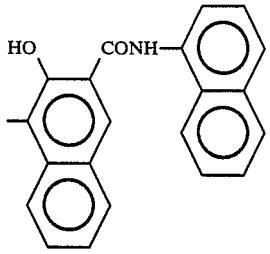 |
| CG-2-15 | 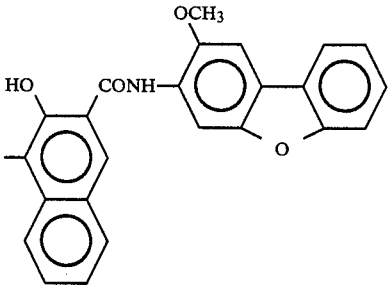 |
| CG-2-16 | 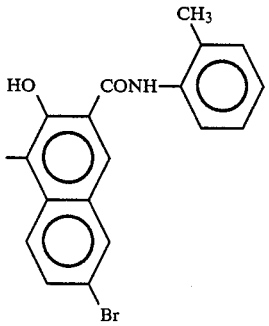 |
TABLE 2-2-continued
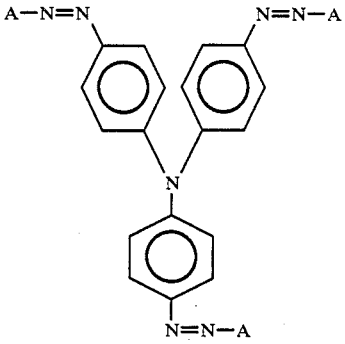
(CG-2)
| Pigment No. | A |
|---|---|
| CG-2-17 | 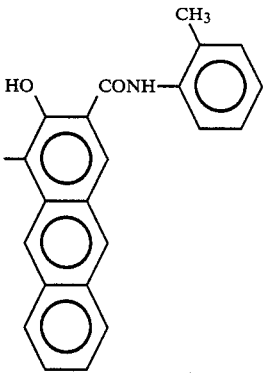 |
| CG-2-18 | 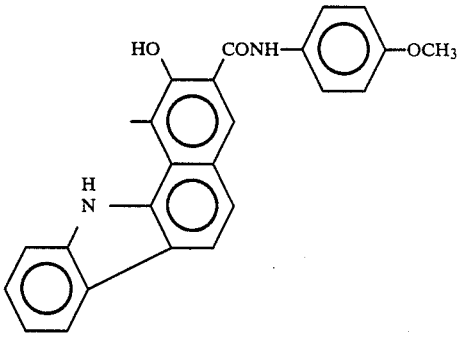 |
| CG-2-19 | 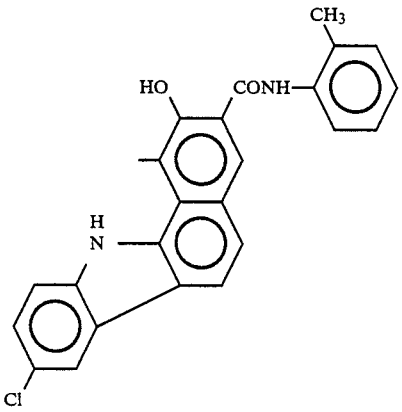 |

TABLE 2-2-continued
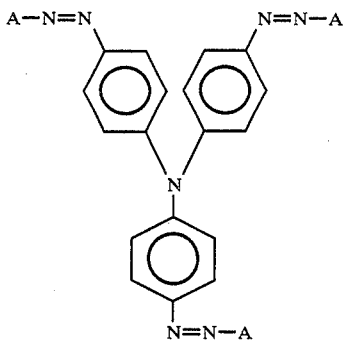
(CG-2)
| Pigment No. | A |
|---|---|
| CG-2-20 | 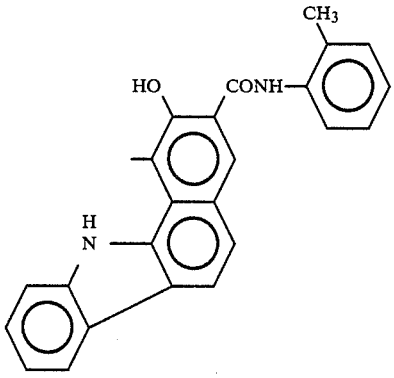 |
| CG-2-21 | 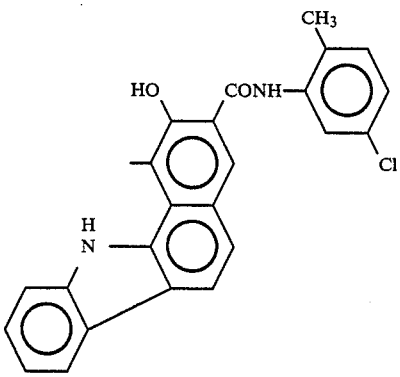 |
| CG-2-22 | 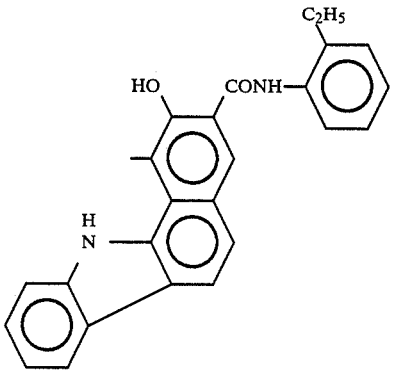 |
TABLE 2-2-continued
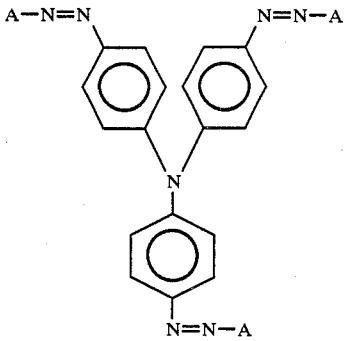
(CG-2)
| Pigment No. | A |
|---|---|
| CG-2-23 | 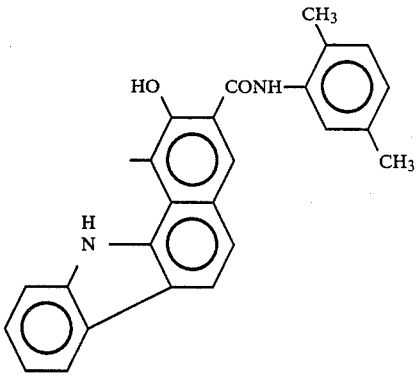 |
| CG-2-24 | 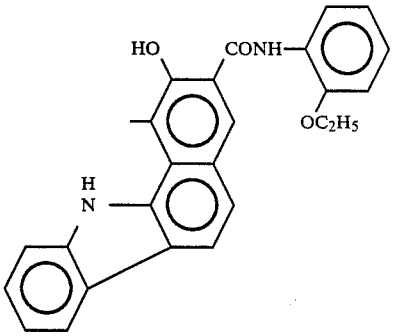 |
| CG-2-25 | 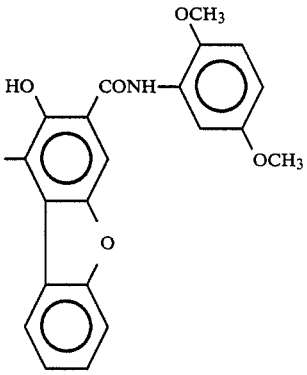 |

TABLE 2-2-continued
(CG-2)
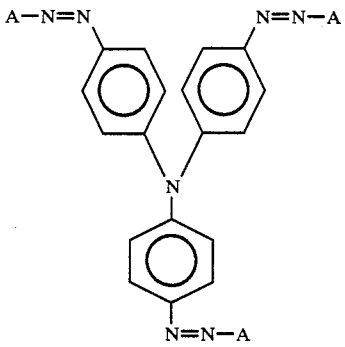
| Pigment No. | A |
|---|---|
| CG-2-26 | 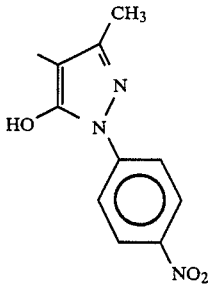 |
| CG-2-27 | 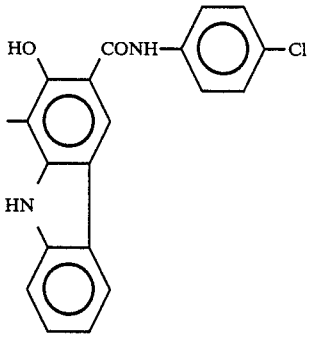 |
TABLE 2-2-continued
(CG-2)
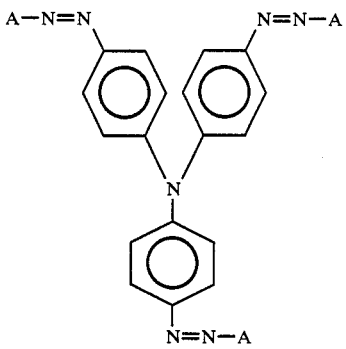
| Pigment No. | A |
|---|---|
| CG-2-28 | 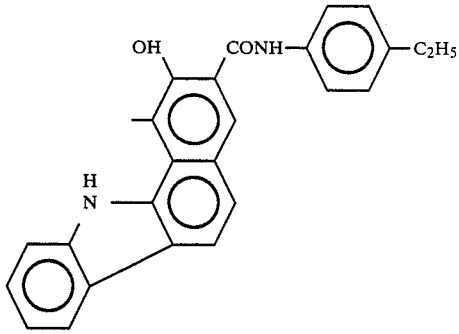 |
TABLE 2-3
(CG-3)
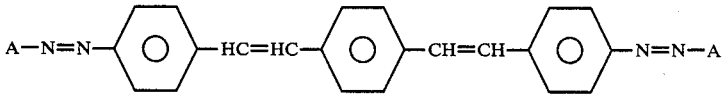
(CG-4)
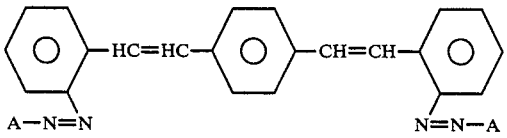
| Pigment No. | A |
|---|---|
| CG-3-1<br>CG-4-1 | 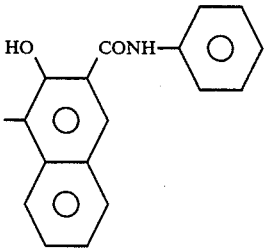 |

TABLE 2-3-continued
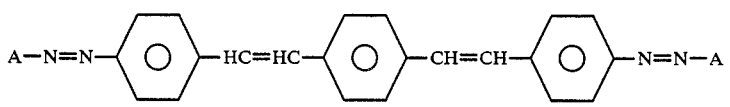
(CG-3)
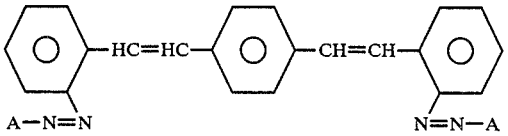
(CG-4)
| Pigment No. | A |
|---|---|
| CG-3-2<br>CG-4-2 | 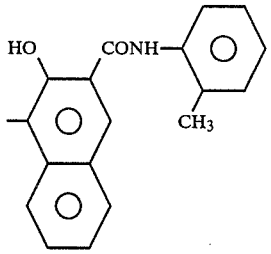 |
| CG-3-3<br>CG-4-3 | 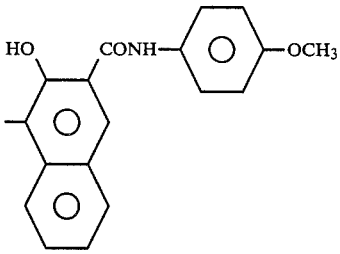 |
| CG-3-4<br>CG-4-4 | 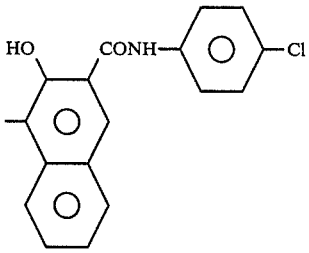 |
| CG-3-5<br>CG-4-5 | 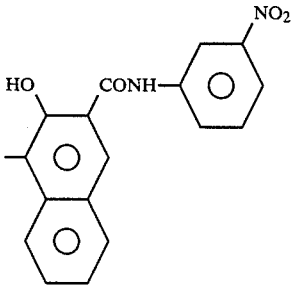 |

TABLE 2-3-continued
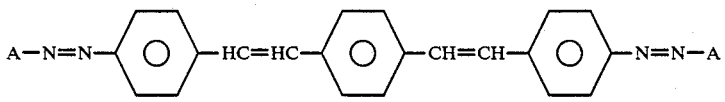
(CG-3)
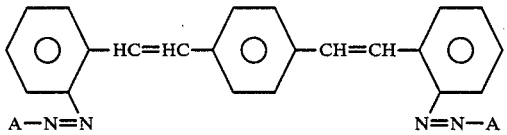
(CG-4)
| Pigment No. | A |
|---|---|
| CG-3-6<br>CG-4-6 | 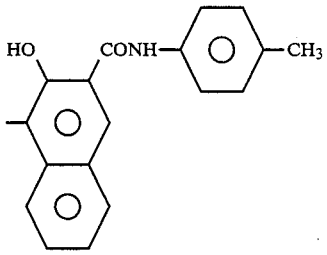 |
| CG-3-7<br>CG-4-7 | 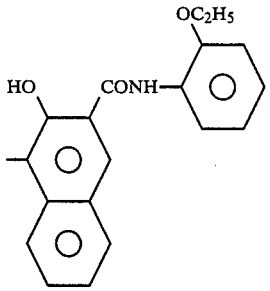 |
| CG-3-8<br>CG-4-8 | 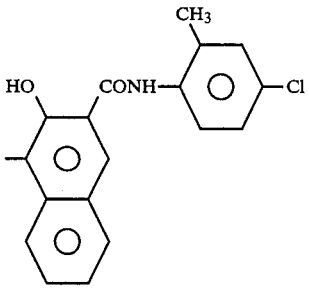 |
| CG-3-9<br>CG-4-9 | 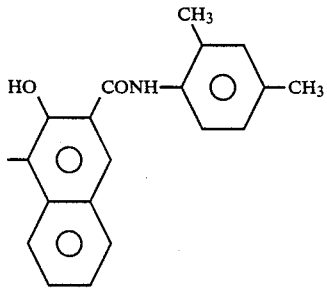 |

TABLE 2-3-continued
(CG-3)
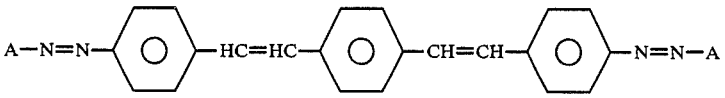
(CG-4)
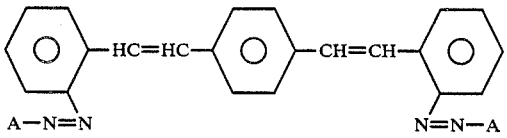
| Pigment No. | A |
|---|---|
| CG-3-10<br>CG-4-10 | 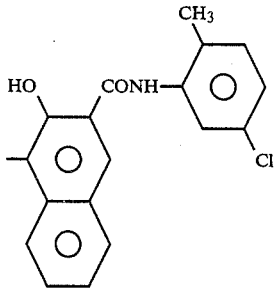 |
| CG-3-11<br>CG-4-11 | 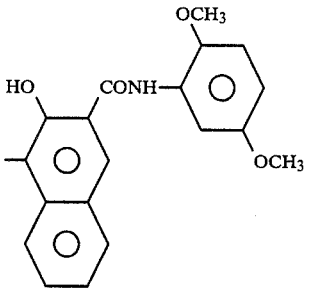 |
| CG-3-12<br>CG-4-12 | 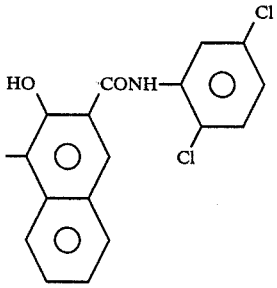 |
| CG-3-13<br>CG-4-13 | 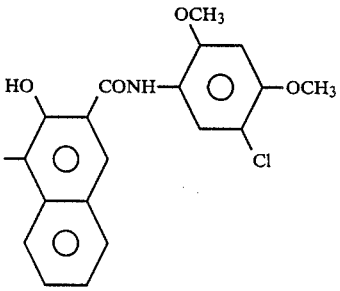 |

TABLE 2-3-continued
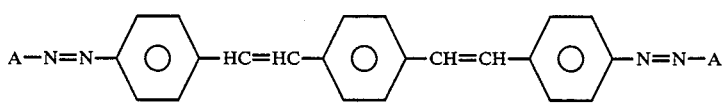
(CG-3)
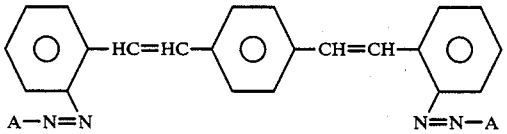
(CG-4)
| Pigment No. | A |
|---|---|
| CG-3-14<br>CG-4-14 | 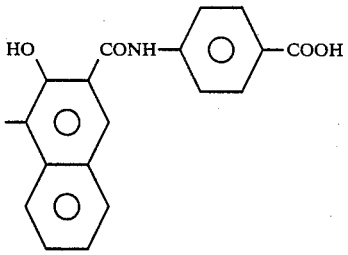 |
| CG-3-15<br>CG-4-15 | 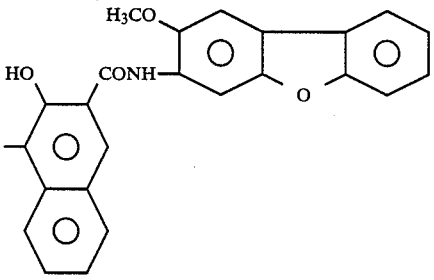 |
| CG-3-16<br>CG-4-16 | 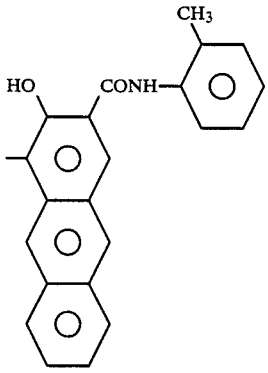 |
| CG-3-17<br>CG-4-17 | 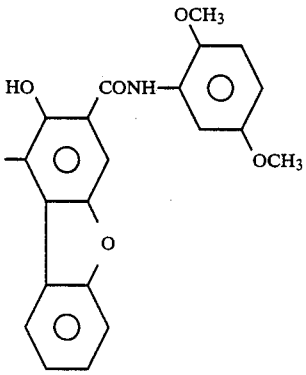 |

TABLE 2-3-continued
(CG-3)
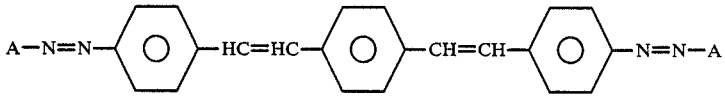
(CG-4)
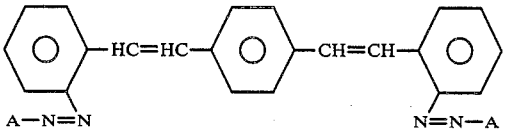
| Pigment No. | A |
|---|---|
| CG-3-18<br>CG-4-18 | 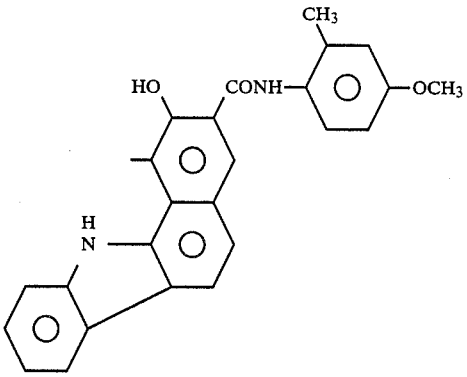 |
| CG-3-19<br>CG-4-19 | 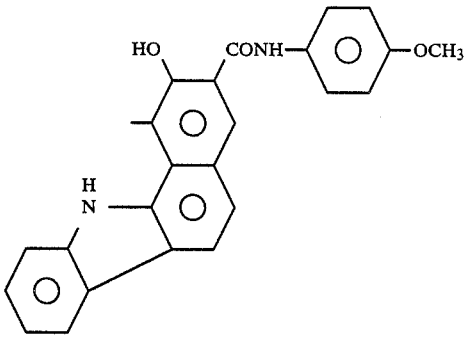 |
| CG-3-20<br>CG-4-20 | 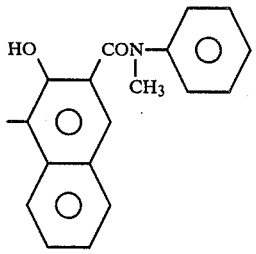 |
| CG-3-21<br>CG-4-21 | 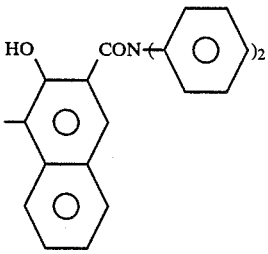 |

TABLE 2-3-continued (CG-3)

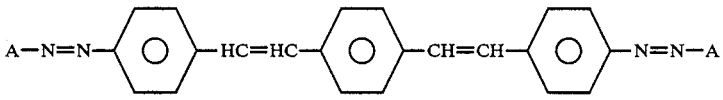

(CG-4)

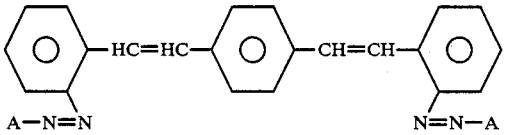

| Pigment No. | A |
|---|---|
| CG-3-22<br>CG-4-22 | 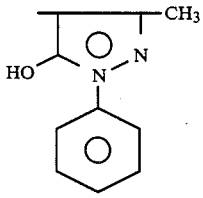 |
| CG-3-23<br>CG-4-23 | 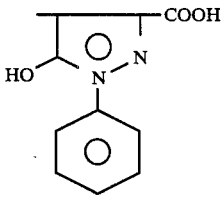 |
| CG-3-24<br>CG-4-24 | 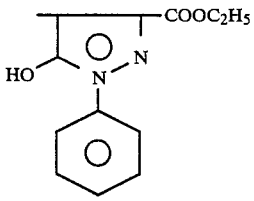 |

The azo pigments in Tables 2-1, 2-2 and 2-3, when used in the charge generating layer, are dispersed in an organic solvent. A resin may be added to this dispersion. For dispersing the mixture, the conventional methods, using, for instance, a ball mill, can be employed.

It is required that a resin for use in combination with these pigments have adhesive and insulating properties. Specific examples of such resin are condensation resins such as polyamide, polyurethane, polyester, epoxy resin, polycarbonate and polyether, and polymers and copolymers such as polystyrene, polyacrylate, polymethacrylate, poly-N-vinylcarbazole, polyvinyl butyral, styrene-butadiene copolymer, and styrene-acrylonitrile copolymer.

Such charge generating layer can be formed in the same manner as in the intermediate layer. In this case, it is preferable that the thickness of the charge generating layer be in the range of about 0.05 μm to about 0.5 μm. It is preferable that the content of the organic dye or pigment in the charge generating layer be 60 wt. % or more.

In the case where crystalline selenium particles or arsenic selenide particles are employed in the charge generating layer, they are dispersed in an electron-donating binder agent in the same manner as in the case of the previously mentioned intermediate layer.

The above crystalline selenium particles can be prepared by a convention method, for example, by dissolving selenium with high purity in a concenctrated strong alkaline aqueous solution with the application of heat thereto, followed by adding dropwise the solution to pure water or by neutralizing the solution with an acid, so that the selenium is separated in the form of crystals of hexagonal system.

The arsenic selenide particles can be obtained by evaporating arsenic selenide onto an appropriate substrate under application of heat in the atmosphere of a nitrogen gas or an inert gas at a reduced pressure of 0.01 Torr to 1 Torr, and scraping the deposited arsenic selenide from the substrate.

Examples of an electron-donating organic compound in which the crystalline selenium particles and the arsenic selenide particles are dispersed for the formation of the charge generating layer are polyvinylcarbazole and derivatives thereof such as those having a substituent (for example, halogen such as chlorine and bromine, methyl group and amino group) in the carbazole skeleton, polyvinyl pyrene, oxadiazole, pyrazoline, hydrozone, diaryl methane, α-phenylstilbene, nitrogen-containing compounds such as triphenylamine, and diaryl methane type compounds. These can be used alone or in combination.

Of the above compunds, polyvinylcarbazole and the derivatives thereof are most preferable as the electron-donating organic compound in combination with the crystalline selenium particles and the arsenic selenide particles. When the above compounds are used in combination, it is preferable to use them in combination with the polyvinylcarbazole or a derivative thereof. The reasons for this are that polyvinyl carbazole and the derivatives thereof have higher ionization potential than other electron-donating compounds and that they can be easily coated in the form of a layer when forming a charge generating layer because they themselves are polymers.

It is preferable that the content of the charge generating material be in the range of 30 wt. % to 90 wt. % of the entire weight of the charge generating layer. The charge generating layer can be formed in the same manner as in the previously mentioned intermediate layer. In this case, it is preferable that the thickness of the charge generating layer be in the range of about 0.2 μm to about 5 μm.

The charge transporting layer formed on the charge generating layer serves to maintain the electric charge applied thereto and to combine the applied electric charge with the electric charge generated in the charge generating layer and separated therefrom by the photoconductor being exposed to light. Therefore it is required that the charge transporting layer have high electric resistivity for retaining the electric charge on the surface thereof, and have a small dielectric constant and an excellent charge transporting property in order to obtain high surface potential with the electric charge retained therein. In order to meet these requirements, an organic charge transporting material is preferably employed in the charge transporting layer.

As such organic charge transporting materials, conventionally known compounds, for instance, poly-N-vinylcarbazole compounds, pyrazolne compounds, α-phenylstilbene compounds, hydrazone compounds, diarylmethane compounds, triphenylamine compounds, divinylbenzene compounds, fluorene compounds, antharacene compounds, oxadiazole compounds, and diaminocarbazole compounds can be employed in the present invention.

The organic charge transporting materials other than poly-N-vinylcarbazole can be employed in combination with a binder agent such as polycarbonate as in the charge generating layer. It is not necessary that the resins for use in the charge transporting layer be the same as the resins for use in the charge generating layer.

When necessary, a plasticizer may be added to the charge transporting layer. Examples of a plasticizer for use in the present invention are halogenated paraffin, dimethylnaphthalene, dibutyl phthalate, dioctyl phthalate, tricrysyl phosphate, polymers and copolymers such as polyester.

The charge transporting layer can be formed in the same manner as in the intermediate layer and the charge generating layer, for instance, by dissolving in an organic solvent any of the above charge transporting materials, any of the above-mentioned binder agents, and a silicone oil which serves as a leveling agent when forming the charge transporting layer, coating the dispersion on the charge generating layer, and drying the same.

It is preferable that the thickness of the charge transporting layer be in the range of about 5 μm to about 30 μm.

Further, it is preferable that the ratio by weight of the charge transporting material to the resinous binder agent be 2:8 to 8:2, and the relative amount of the silicone oil to the resinous binder agent be in the range of 0.001 wt. % to 1 wt. %.

By referring to the following examples, the present invention will now be explained in more detail. These examples are, of course, for the specific illustration of the present invention. Therefore, the present invention is not be restricted by these examples.

EXAMPLE A-1

(1) Preparation of Intermediate Layer Coating Liquid

Resin Liquid 1

Resin Liquid 1 was prepared by mixing the following components:

| | Parts by Weight |
|---|---|
| Polyvinyl butyral (Trademark "BL-1" made by Sekisui Chemical Co., Ltd.) | 8 |
| Cyclohexanone | 92 |

A milling pot made of glass having a diameter of 12 cm was half filled with sintered alumina balls having a diameter of 1 cm.

In this milling pot, 120 g of the above prepared resin liquid, 10.5 g of Azo Pigment No. I-27 in Table 1-1, and 100 g of methyl ethyl ketone were placed.

The mixture was then subjected to milling for 72 hours. Thereafter, 120 g of methyl ethyl ketone was added and the milling was continued for another 24 hours. Thus, 280 g of a dispersion was obtained.

To the thus obtained dispersion, 24 g of a TDI solution of the following formulation and 40 g of methyl ethyl ketone were added dropwise, with stirring, whereby an intermediate layer coating liquid was prepared: TDI Solution

| | Parts by Weight |
|---|---|
| Tolylene diisocyanate (TDI) | 10 |
| Methyl ethyl ketone | 90 |

(2) Preparation of Charge Generating Layer Coating Liquid

A milling pot made of glass having a diameter of 15 cm was half filled with stainless steel balls having a diameter of 1 cm. To this milling pot, 400 g of a cyclohexanone solution containing 2.5 wt. % of polyvinyl butyral ("BL-1") and 25 g of Azo Pigment No. CG-1-8 in Table 2-1 were added.

The mixture was milled for 48 hours. To this mixture, 408 g of cyclohexanone was added, and the mixture was further milled for 24 hours, whereby 800 g of a dispersion was obtained.

800 g of tetrahydrofuran was then added dropwise to the above obtained dispersion, whereby a charge generating layer coating liquid was prepared.

(3) Preparation of Charge Transporting Layer Coating Solution

A charge transporting layer coating solution was prepared by mixing the following components:

| | Parts by Weight |
|---|---|
| α-phenylstilbene type charge transporting material having the formula: | 10 |

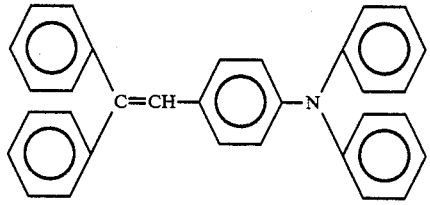

| | |
|---|---|
| Polycarbonate (Trademark "Panlite C-1400" made by Teijin Limited) | 10 |
| Silicone oil (Trademark "KF-50") | 0.0002 |
| Tetrahydrofuran | 80 |

(4) Preparation of Electrophotographic Photoconductor No. A-1 According to the Present Invention An aluminum plate having a thickness of 0.3 mm which was cleaned by a vapor of perchloroethylene.

The thus cleaned aluminum plate was immersed into the above prepared intermediate layer coating liquid, and then pulled out to coat the intermediate layer coating liquid on the aluminum plate. The intermediate layer coating liquid coated aluminum plate was then heated at 130° C. for 1 hour, so that the coated liquid was thermally hardened. Thus an intermediate layer having a thickness of 1.5 μm was formed on the aluminum plate.

The aluminum plate with the intermediate layer formed thereon was then immersed into the above prepared charge generating layer coating liquid and was then pulled out at a speed of 5.0 mm/sec, whereby the charge generating layer coating liquid was coated on the intermediate layer. The thus coated charge generating layer coating liquid was then hardened by the application of heat at 130° C. for 10 minutes, whereby a charge generating layer was formed on the intermediate layer.

The aluminum plate with the intermediate layer and the charge generating layer successively formed thereon was then immersed into the previously prepared charge transporting layer coating liquid and was then pulled out, whereby the charge transporting layer coating liquid was coated on the charge generating layer.

The thus coated charge transporting layer coating liquid was hardened by the application of heat at 130° C. for 1 hour, whereby a charge transporting layer was formed on the charge generating layer.

The entire thickness of the thus formed photoconductive layer consisting of the charge generating layer and the charge transporting layer was 22 μm. Thus an electrophotographic photoconductor No. A-1 according to the present invention was prepared.

COMPARATIVE EXAMPLE CA-1

Example A-1 was repeated except that the intermediate layer formed in Example A-1 was eliminated, whereby a comparative electrophotographic photoconductor No. CA-1 was prepared.

COMPARATIVE EXAMPLE CA-2

Example A-1 was repeated except that the intermediate layer coating liquid employed in Example A-1 was replaced by Resin Liquid 2 of the following formulaion, and an intermediate layer formed by coating this resin liquid was heated at 130° C. for 1 hour, thereby forming an intermediate layer having a thickness of 1.2 μm, thus a comparative electrophotographic photoconductor No. CA-2 was prepared:

Resin Liquid 2

Resin Liquid 2 was prepared by mixing the following components:

| | Parts by Weight |
|---|---|
| Polyvinyl butyral (Trademark "BL-1" made by Sekisui Chemical Co., Ltd.) | 48 |
| Tolylene diisocyanate (TDI) | 14.5 |
| Cyclohexanone | 552 |
| Methyl ethyl ketone | 130 |

COMPARATIVE EXAMPLE CA-3

Example A-1 was repeated except that the intermediate layer coating liquid employed in Example A-1 was replaced by Resin Liquid 3 of the following formulation, and an intermediate layer formed by coating this resin liquid was heated at 130° C. for 10 minutes, thereby forming an intermediate layer having a thickness of 1.2 μm, thus a comparative electrophotographic photoconductor No. CA-3 was prepared:

Resin Liquid 3

Resin Liquid 3 was prepared by mixing the following components:

| | Parts by Weight |
|---|---|
| Nylon resin (Trademark "CM-8000" made by Toray Industries, Inc.) | 8 |
| Methanol | 60 |
| Butanol | 32 |

EXAMPLE A-2

(1) Preparation of Intermediate Layer Coating Liquid

The same intermediate layer coating liquid as that employed in Example A-1 was prepared.

(2) Preparation of Charge Generating Layer Coating Liquid

A milling pot made of glass having a diameter of 15 cm was half filled with stainless balls having a diameter of 1 cm. To this milling pot, 400 g of Resin Liquid 4 of the following formulation and 25 g of Azo Pigment No. CG-2-22 in Table 2-2 were added. The mixture was milled for 48 hours. To this mixture, 580 g of Resin Liquid 4 of the following formulation was further added, and the mixture was further milled for 24 hours, so that 950 g of a dispersion was obtained. To this dispersion, 710 g of methyl ethyl ketone was added dropwise, whereby a charge generating layer coating liquid was prepared.

Resin Liquid 4

Resin Liquid 4 was prepared by mixing the following components:

| | Parts by Weight |
|---|---|
| Polyvinyl butyral (Trademark "XYHL" made by Union Carbide Corp.) | 10 |
| Cyclohexanone | 970 |

(3) Preparation of Charge Transporting Layer Coating Solution

A charge transporting layer coating solution was prepared by mixing the following components:

| | Parts by Weight |
|---|---|
| α-phenylstilbene type charge transporting material having the formula: | 10 |

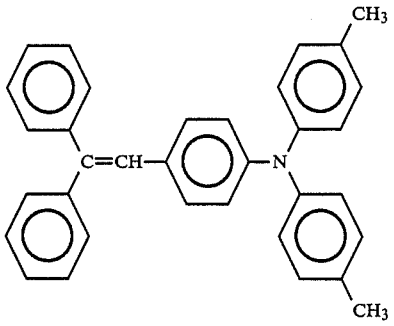

| | |
|---|---|
| Polycarbonate (Trademark "Panlite C-1400" made by Teijin Limited) | 10 |
| Silicone oil (Trademark "KF-50") | 0.0002 |
| Tetrahydrofuran | 80 |

(4) Preparation of Electrophotographic Photoconductor No. A-2 According to the Present Invention An aluminum plate having a thickness of 0.3 mm which was cleaned by a vapor of perchloroethylene.

The thus cleaned aluminum plate was immersed into the above prepared intermediate layer coating liquid, and then pulled out to coat the intermediate layer coating liquid on the aluminum plate. The intermediate layer coating liquid coated aluminum plate was then heated at 130° C. for 1 hour, so that the coated liquid was thermally hardened. Thus an intermediate layer having a thickness of 1.5 μm was formed on the aluminum plate.

The aluminum plate with the intermediate layer formed thereon was then immersed into the above prepared charge generating layer coating liquid and was then pulled out at a speed of 6 mm/sec, whereby the charge generating layer coating liquid was coated on the intermediate layer. The thus coated charge generating layer coating liquid was then hardened by the application of heat at 130° C. for 10 minutes, whereby a charge generating layer was formed on the intermediate layer.

The aluminum plate with the intermediate layer and the charge generating layer successively formed thereon was then immersed into the previously prepared charge transporting layer coating liquid and was then pulled out, whereby the charge transporting layer coating liquid was coated on the charge generating layer.

The thus coated charge transporting layer coating liquid was then hardened by the application of heat at 130° C. for 1 hour, whereby a charge transporting layer was formed on the charge generating layer.

The entire thickness of the thus formed photoconductive layer consisting of the charge generating layer and the charge transporting layer was 22 μm. Thus an electrophotographic photoconductor No. A-2 according to the present invention was prepared.

COMPARATIVE EXAMPLE CA-4

Example A-2 was repeated except that the intermediate layer formed in Example A-2 was eliminated, whereby a comparative electrophotographic photoconductor No. CA-4 was prepared.

COMPARATIVE EXAMPLE CA-5

Example A-2 was repeated except that the intermediate layer coating liquid employed in Example A-2 was replaced by Resin Liquid 2 employed in Comparative Example CA-2, and an intermediate layer formed by coating this resin liquid was heated at 130° C. for 1 hour, thereby forming an intermediate layer having a thickness of 1.2 μm, thus a comparative electrophotographic photoconductor No. CA-5 was prepared.

COMPARATIVE EXAMPLE CA-6

Example A-2 was repeated except that the intermediate layer coating liquid employed in Example A-2 was replaced by Resin Liquid 3 employed in Comparative Example CA-3, and an intermediate layer formed by coating this resin liquid was heated at 130° C. for 10 minutes, thereby forming an intermediate layer having a thickness of 1.2 μm, thus a comparative electrophotographic photoconductor No. CA-6 was prepared.

EXAMPLE A-3

(1) Preparation of Intermediate Layer Coating Liquid

The same intermediate layer coating liquid as that employed in Example A-1 was prepared.

(2) Preparation of Charge Generating Layer Coating Liquid

A milling pot made of glass having a diameter of 15 cm was half filled with sintered alumina balls having a diameter of 1 cm. To this milling pot, 400 g of Resin Liquid 4 employed in Example A-2 and 25 g of Azo Pigment No. CG-4-9 were added. The mixture was then milled for 48 hours. To this mixture, 580 g of Resin Liquid 4 was further added. This mixture was further milled for 24 hours, so that 950 g of a dispersion was obtained. To this dispersion, 710 g of methyl ethyl ketone was added dropwise, whereby a charge generating layer coating liquid was prepared.

(3) Preparation of Charge Transporting Layer Coating Solution

A charge transporting layer coating solution was prepared by mixing the following components:

| | Parts by Weight |
|---|---|
| Hydrazone type charge transporting material having the formula: 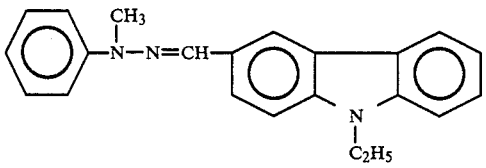 | 10 |
| Polycarbonate (Trademark "Panlite C-1400" made by Teijin Limited) | 10 |
| Silicone oil (Trademark "KF-50") | 0.0002 |
| Tetrahydrofuran | 80 |

(4) Preparation of Electrophotographic Photoconductor No. 3 According to the Present Invention An aluminum plate having a thickness of 0.3 mm which was cleaned by a vapor of perchloroethylene.

The thus cleaned aluminum plate was immersed into the above prepared intermediate layer coating liquid, and then pulled out to coat the intermediate layer coating liquid on the aluminum plate. The intermediate layer coating liquid coated aluminum plate was then heated at 130° C. for 1 hour, so that the coated liquid was thermally hardened. Thus an intermediate layer having a thickness of 1.5 μm was formed on the aluminum plate.

The aluminum plate with the intermediate layer formed thereon was then immersed into the above prepared charge generating layer coating liquid and was then pulled out at a speed of 6 mm/sec, whereby the charge generating layer coating liquid was coated on the intermediate layer. The thus coated charge generating layer coating liquid was then hardened by the application of heat at 130° C. for 10 minutes, whereby a charge generating layer was formed on the intermediate layer.

The aluminum plate with the intermediate layer and the charge generating layer successively formed thereon was then immersed into the previously prepared charge transporting layer coating liquid and was then pulled out, whereby the charge transporting layer coating liquid was coated on the charge generating layer.

The thus coated charge transporting layer coating liquid was then hardened by the application of heat at 130° C. for 1 hour, whereby a charge transporting layer was formed on the charge generating layer.

The entire thickness of the thus formed photoconductive layer consisting of the charge generating layer and the charge transporting layer was 22 μm. Thus an electrophotographic photoconductor No. A-3 according to the present invention was prepared.

COMPARATIVE EXAMPLE CA-7

Example A-3 was repeated except that the intermediate layer formed in Example A-3 was eliminated, whereby a comparative electrophotographic photoconductor No. CA-7 was prepared.

COMPARATIVE EXAMPLE CA-8

Example A-3 was repeated except that the intermediate layer coating liquid employed in Example A-3 was replaced by Resin Liquid 2 employed in Comparative Example CA-2, and an intermediate layer formed by coating this resin liquid was heated at 130° C. for 1 hour, thereby forming an intermediate layer having a thickness of 1.2 μm, thus a comparative electrophotographic photoconductor No. CA-8 was prepared.

COMPARATIVE EXAMPLE CA-9

Example A-3 was repeated except that the intermediate layer coating liquid employed in Example A-3 was replaced by Resin Liquid 3 employed in Comparative Example CA-3, and an intermediate layer formed by coating this resin liquid was heated at 130° C. for 10 minutes, thereby forming an intermediate layer having a thickness of 1.2 μm, thus a comparative electrophotographic photoconductor No. CA-9 was prepared.

EXAMPLE A-4-1

(1) Preparation of Intermediate Layer Coating Liquid

The same intermediate layer coating liquid as that employed in Example A-1 was prepared.

(2) Preparation of Charge Generating Layer Coating Liquid (2)-1 Preparation of Crystalline Selenium Particles 40 g of a 50 wt. % aqueous solution of sodium hydroxide and 4.74 g of amorphous selenium particles with a purity of 99.99% were placed in a 100 ml. Erlenmeyer flask. The mixture was heated, with stirring, at 85° C. for 3 hours, so that the amorphous selenium particles were dissolved in the aqueous solution of sodium hydroxide.

To this solution, pure water was added until the total weight of the mixture amounted to 60 g. The mixture was then allowed to stand at room temperature for 18 hours.

740 ml of pure water was placed in a 1 l. Erlenmeyer flask. To this pure water in the flask, the above mixture was added dropwise, with stirring, so that the mixture was diluted with the pure water.

25 g of a 30% aqueous solution of hydrogen peroxide was added dropwise to the above mixture, so that crystalline selenium particles were caused to separate from the mixture. The crystalline selenium particles were filtered off, washed with about 700 ml of water five times, and then dried at 50° C. under reduced pressure, whereby about 3 g of pure crystalline selenium particles was obtained. It was confirmed by an X-ray diffraction analysis that the thus obtained selenium particles are of hexagonal system.

(2)-2 Preparation of Resin Liquid 5

Resin Liquid 5 was prepared by mixing the following components:

| | Parts by Weight |
|---|---|
| Polyvinylcarbazole (Trademark "Luvican") | 5 |
| Tetrahydrofuran | 45 |
| Toluene | 45 |

(2)-3 Preparation of Charge Generating Layer Coating Liquid

In a 50 ml. milling container made of glass, 140 g of stainless steel balls having a diameter of 0.36 cm, 1.0 g of the above obtained crystalline selenium particles, and 12 g of Resin Liquid 5 were placed, and the mixture was milled, whereby a charge generating layer coating liquid was prepared.

(3) Preparation of Charge Transporting Layer Coating Solution

A charge transporting layer coating solution was prepared by mixing the following components:

| | Parts by Weight |
|---|---|
| N,N'—diphenyl-N,N'—bis(2-methylphenyl)-[1,1-biphenyl]-4,4'-diamine | 9 |
| Polycarbonate (Trademark "Panlite C-1400" made by Teijin Limited) | 9 |
| Silicone oil (Trademark "KF-50") | 0.0001 |
| Dichloromethane | 102 |

(4) Preparation of Electrophotographic Photoconductor No. 4-1 According to the Present Invention An aluminum plate having a thickness of 0.3 mm which was cleaned by a vapor of perchloroethylene.

The thus cleaned aluminum plate was immersed into the above prepared intermediate layer coating liquid, and then pulled out to coat the intermediate layer coating liquid on the aluminum plate. The intermediate layer coating liquid coated aluminum plate was then heated at 130° C. for 1 hour, so that the coated liquid was thermally hardened. Thus an intermediate layer having a thickness of 1.5 um was formed on the aluminum plate.

The aluminum plate with the intermediate layer formed thereon was then coated with the above prepared charge generating layer coating liquid by a doctor blade and was then dried at 100° C. for 30 minutes, so that a charge generating layer having a thickness of 2 μm was formed on the intermediate layer.

The aluminum plate with the intermediate layer and the charge generating layer successively formed thereon was then coated with the previously prepared charge transporting layer coating liquid by a doctor blade and was then dried at 100° C. for 30 minutes, so that a charge transporting layer having a thickness of 20 μm was formed on the charge generating layer layer. Thus an electrophotographic photoconductor No. A-4-1 according to the present invention was prepared.

EXAMPLE A-4-2

Example A-4-1 was repeated except that the charge transporting material in the formulation of the charge transporting layer coating liquid employed in Example A-4-1 was replaced by the following α-phenylstilbene type charge transporting material which was employed in Example A-1, whereby an electrophotographic photoconductor No. A-4-2 according to the present invention was prepared:

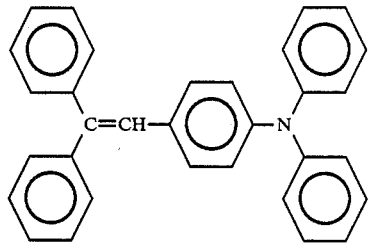

COMPARATIVE EXAMPLE CA-10

Example A-4-1 was repeated except that the intermediate layer formed in Example A-4-1 was eliminated, whereby a comparative electrophotographic photoconductor No. CA-10 was prepared.

COMPARATIVE EXAMPLE CA-11

Example A-4-1 was repeated except that the intermediate layer coating liquid employed in Example A-4-1 was replaced by Resin Liquid 2 employed in Comparative Example CA-2, and an intermediate layer formed by coating this resin liquid was heated at 130° C. for 1 hour, thereby forming an intermediate layer having a thickness of 1.2 μm, whereby a comparative electrophotographic photoconductor No. CA-11 was prepared.

COMPARATIVE EXAMPLE CA-12

Example A-4-1 was repeated except that the intermediate layer coating liquid employed in Example A-4-1 was replaced by Resin Liquid 3 employed in Comparative Example CA-3, and an intermediate layer formed by coating this resin liquid was heated at 130° C. for 10 minutes, thereby forming an intermediate layer having a thickness of 1.2 μm, whereby a comparative electrophotographic photoconductor No. CA-12 was prepared.

COMPARATIVE EXAMPLE CA-13

Example A-4-2 was repeated except that the intermediate layer formed in Example A-4-2 was eliminated, whereby a comparative electrophotographic photoconductor No. CA-13 was prepared.

COMPARATIVE EXAMPLE CA-14

Example A-4-2 was repeated except that the intermediate layer coating liquid employed in Example A-4-2 was replaced by Resin Liquid 2 employed in Comparative Example CA-2, and an intermediate layer formed by coating this resin liquid was heated at 130° C. for 1 hour, thereby forming an intermediate layer having a thickness of 1.2 μm, whereby a comparative electrophotographic photoconductor No. CA-14 was prepared.

COMPARATIVE EXAMPLE CA-15

Example A-4-2 was repeated except that the intermediate layer coating liquid employed in Example A-4-2 was replaced by Resin Liquid 3 employed in Comparative Example CA-3, and an intermediate layer formed by coating this resin liquid was heated at 130° C. for 10 minutes, thereby forming an intermediate layer having a thickness of 1.2 μm, whereby a comparative electrophotographic photoconductor No. CA-15 was prepared.

EXAMPLE A-5-1

(1) Preparation of Intermediate Layer Coating Liquid

The same intermediate layer coating liquid as that employed in Example A-1 was prepared.

(2) Preparation of Charge Generating Layer Coating Liquid (2)-1 Preparation of Arsenic Selenide Particles 20 g of an $As_2Se_3$ alloy held in an evaporation boat provided with an electric heater was placed in a vacuum tank with the inner pressure reduced to $10^{-2}$ Torr by a vacuum pump.

A nitrogen gas with a purity of 99.999% was introduced into this vacuum tank through an inlet thereof, amd the inner pressure of the tank was maintained in the range of 0.2 to 0.4 Torr. The temperature of the evaporation boat was then elevated to 420° to 430° C. and maintained in this range by the electric heater, so that the $As_2Se_3$ alloy was evaporated onto the inner wall of the vacuum tank.

The thus deposited arsenic selenide was scraped off the inner wall and collected, whereby finely-divided arsenic selenide particles were obtained. The particles were brown in color and spherical, and the particle size thereof was in the range of 0.1 μm to 1 μm.

(2)-2 Preparation of Resin Liquid 5

Resin Liquid 5 employed in Example A-4-1 was prepared by mixing the following components:

| | Parts by Weight |
|---|---|
| Polyvinylcarbazole (Trademark "Luvican") | 5 |
| Tetrahydrofuran | 45 |
| Toluene | 45 |

(2)-3 Preparation of Charge Generating Layer Coating Liquid

In a 30 m . milling container made of glass, 70 g of stainless steel balls having a diameter of 0.36 cm, 0.5 g of the above obtained finely-divided arsenic selenide particles, and 9.5 g of Resin Liquid 5 were placed, and the mixture was milled, whereby a charge generating layer coating liquid was prepared.

(3) Preparation of Charge Transporting Layer Coating Solution

A charge transporting layer coating solution was prepared by mixing the following components:

-continued

| | Parts by Weight |
|---|---|
| α-phenylstilbene type charge transporting material having the formula: 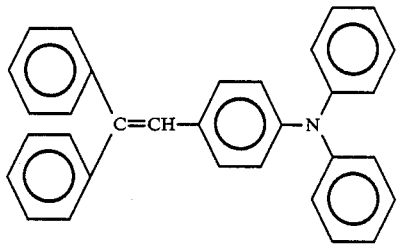 | 9 |
| Polycarbonate (Trademark "Panlite C-1400" made by Teijin Limited) | 9 |
| Silicone oil (Trademark "KF-50") | 0.0002 |
| Dichloromethane | 102 |

(4) Preparation of Electrophotographic Photoconductor No. A-5-1 According to the Present Invention An aluminum plate having a thickness of 0.3 mm which was cleaned by a vapor of perchloroethylene.

The thus cleaned aluminum plate was immersed into the above prepared intermediate layer coating liquid, and then pulled out to coat the intermediate layer coating liquid on the aluminum plate. The intermediate layer coating liquid coated aluminum plate was then heated at 130° C. for 1 hour, so that the coated liquid was thermally hardened. Thus an intermediate layer having a thickness of 1.5 μm was formed on the aluminum plate.

The aluminum plate with the intermediate layer formed thereon was then coated with the above prepared charge generating layer coating liquid by a doctor blade and was then dried at 100° C. for 30 minutes, so that a charge generating layer having a thickness of 2 μm was formed on the intermediate layer.

The aluminum plate with the intermediate layer and the charge generating layer successively formed thereon was then coated with the previously prepared charge transporting layer coating liquid by a doctor blade and was then dried at 100° C. for 30 minutes, so that a charge transporting layer having a thickness of 20 μm was formed on the charge generating layer layer. Thus an electrophotographic photoconductor No. A-5-1 according to the present invention was prepared.

EXAMPLE A-5-2

Example A-5-1 was repeated except that the charge transporting material in the formulation of the charge transporting layer coating liquid employed in Example A-5-1 was replaced by the charge transporting material, N,N'-diphenyl-N,N'-bis(2-methylphenyl)-[1,1'-biphenyl]-4,4'-diamine, which was employed in Example A-4-1, whereby an electrophotographic photoconductor No. A-5-2 according to the present invention was prepared.

COMPARATIVE EXAMPLE CA-16

Example A-5-1 was repeated except that the intermediate layer formed in Example A-5-1 was eliminated, whereby a comparative electrophotographic photoconductor No. CA-16 was prepared.

COMPARATIVE EXAMPLE CA-17

Example A-5-1 was repeated except that the intermediate layer coating liquid employed in Example A-5-1 was replaced by Resin Liquid 2 employed in Comparative Example CA-2, and an intermediate layer formed by coating this resin liquid was heated at 130° C. for 1 hour, thereby forming an intermediate layer having a thickness of 1.2 μm, whereby a comparative electrophotographic photoconductor No. CA-17 was prepared.

COMPARATIVE EXAMPLE CA-18

Example A-5-1 was repeated except that the intermediate layer coating liquid employed in Example A-5-1 was replaced by Resin Liquid 3 employed in Comparative Example CA-3, and an intermediate layer formed by coating this resin liquid was heated at 130° C. for 10 minutes, thereby forming an intermediate layer having a thickness of 1.2 μm, whereby a comparative electrophotographic photoconductor No. CA-18 was prepared.

COMPARATIVE EXAMPLE CA-19

Example A-5-2 was repeated except that the intermediate layer formed in Example A-5-2 was eliminated, whereby a comparative electrophotographic photoconductor No. CA-19 was prepared.

Each of the thus prepared electrophotographic photoconductors Nos. A-1~A-3, Nos. A-4-1~A-4-2, and Nos. A-5-1~A-5-2 according to the present invention, and the comparative electrophotographic photoconductors Nos. CA-1~CA-19 was negatively charged in the dark under application of −6 kV of corona charge for 20 seconds under the conditions of a temperature of 10° C. and a humidity of 20% (hereinafter referred to as the low temperature and low humidity conditions), and subsequently under the conditions of a temperature of 30° C. and a humidity of 90% (hereinafter referred to as the high temperature and high humidity conditions), so that the respective initial surface potentials $V_i$ at the low temperature and low humidity conditions and at the high temperature and high humidity conditions of each photoconductor were measured by Electrostatic Paper Analyzer (Model SP-428 made by Kawaguchi Electro Works).

Thereafter each photoconductor was allowed to stand in the dark for 20 seconds without applying any charges thereto, so that the corresponding surface potentials $V_{po}$ after dark decay were measured.

Each photoconductor was subsequently illuminated by a tungsten lamp in such a manner that the illuminance on the illuminated surface of the photoconductor was 4.5 lux, so that the exposures $E_{\frac{1}{2}}$ required to respectively reduce the surface potentials $V_{po}$ to $\frac{1}{2}$ of the surface potentials $V_{po}$, and the residual surface potentials $V_e$ after each photoconductor was illuminated by the tungsten lamp for 30 seconds were measured.

In order to assess the durability and fatigue resistance of the photoconductors, each photoconductor was negatively charged in the dark under application of −7.5 kV for 20 seconds and exposed to light of 50 lux in the same manner as mentioned above, and this was repeated for 10 minutes, so that the initial surface potentials $V_i'$, the surface potentials $V_{po}'$ after dark decay, the exposures $E_{\frac{1}{2}}'$, and the residual surface potentials $V_e'$ after fatigued, corresponding to the above $V_i$, $V_{po}$, $E_{\frac{1}{2}}$, and $V_e$, were measured.

The above results are shown in Tables 3A-1 and 3A-2.

TABLE 3A-1

| | Low Temperature & Low Humidity | | | | | | | |
|---|---|---|---|---|---|---|---|---|
| | Before Fatigue | | | After Fatigue | | | | |
| | $V_i$ | $V_{po}/V_i$ | $E_{\frac{1}{2}}$ | $V_e$ | $V_i'$ | $V_{po}'/V_i'$ | $E_{\frac{1}{2}}'$ | $V_e'$ |
| Examples | | | | | | | | |
| A-1 | 1190 | 0.71 | 0.77 | 8 | 1170 | 0.69 | 0.75 | 12 |
| A-2 | 1300 | 0.72 | 0.64 | 5 | 1270 | 0.69 | 0.62 | 7 |
| A-3 | 1400 | 0.87 | 1.23 | 16 | 1420 | 0.88 | 1.25 | 30 |
| A-4-1 | 1240 | 0.75 | 0.83 | 12 | 1240 | 0.74 | 0.82 | 18 |
| A-4-2 | 1260 | 0.77 | 0.85 | 13 | 1270 | 0.77 | 0.86 | 21 |
| A-5-1 | 1260 | 0.68 | 0.81 | 15 | 1250 | 0.66 | 0.80 | 25 |
| A-5-2 | 1250 | 0.64 | 0.78 | 12 | 1230 | 0.61 | 0.75 | 23 |
| Comparative Examples | | | | | | | | |
| CA-1 | 780 | 0.69 | 0.53 | 0 | 540 | 0.18 | 0.30 | 0 |
| CA-2 | 1150 | 0.61 | 0.59 | 102 | 1270 | 0.40 | 0.57 | 192 |
| CA-3 | 1280 | 0.76 | 0.58 | 2 | 1310 | 0.70 | 0.60 | 163 |
| CA-4 | 980 | 0.62 | 0.50 | 0 | 880 | 0.29 | 0.43 | 0 |
| CA-5 | 1200 | 0.60 | 0.58 | 98 | 1260 | 0.43 | 0.61 | 183 |
| CA-6 | 1410 | 0.77 | 0.60 | 6 | 1430 | 0.80 | 0.95 | 237 |
| CA-7 | 1120 | 0.74 | 1.02 | 0 | 930 | 0.24 | 0.68 | 2 |
| CA-8 | 1410 | 0.89 | 1.22 | 106 | 1500 | 0.68 | 1.02 | 202 |
| CA-9 | 1400 | 0.86 | 1.20 | 8 | 1360 | 0.62 | 0.90 | 208 |
| CA-10 | 960 | 0.39 | 0.48 | 2 | 860 | 0.30 | 0.35 | 3 |
| CA-11 | 1300 | 0.79 | 0.86 | 103 | 1400 | 0.75 | 0.89 | 204 |
| CA-12 | 1150 | 0.53 | 0.56 | 6 | 1140 | 0.41 | 0.49 | 161 |
| CA-13 | 1060 | 0.59 | 0.56 | 1 | 970 | 0.37 | 0.42 | 2 |
| CA-14 | 1330 | 0.81 | 0.89 | 99 | 1440 | 0.76 | 0.92 | 208 |
| CA-15 | 1180 | 0.62 | 0.63 | 3 | 1190 | 0.64 | 0.72 | 142 |
| CA-16 | 1060 | 0.40 | 0.58 | 6 | 1020 | 0.29 | 0.37 | 8 |
| CA-17 | 1440 | 0.76 | 0.95 | 101 | 1530 | 0.69 | 0.90 | 198 |
| CA-18 | 1360 | 0.47 | 0.70 | 19 | 1290 | 0.38 | 0.57 | 180 |
| CA-19 | 990 | 0.36 | 0.52 | 10 | 980 | 0.28 | 0.30 | 12 |

TABLE 3A-2

| | High Temperature & High Humidity | | | | | | | |
|---|---|---|---|---|---|---|---|---|
| | Before Fatigue | | | After Fatigue | | | | |
| | $V_i$ | $V_{po}/V_i$ | $E_{\frac{1}{2}}$ | $V_e$ | $V_i'$ | $V_{po}'/V_i'$ | $E_{\frac{1}{2}}'$ | $V_e'$ |
| Examples | | | | | | | | |
| A-1 | 1160 | 0.67 | 0.76 | 3 | 1130 | 0.64 | 0.78 | 7 |
| A-2 | 1280 | 0.69 | 0.59 | 2 | 1240 | 0.64 | 0.60 | 5 |
| A-3 | 1380 | 0.85 | 1.18 | 5 | 1320 | 0.79 | 1.15 | 10 |
| A-4-1 | 1220 | 0.74 | 0.83 | 4 | 1200 | 0.71 | 0.83 | 9 |
| A-4-2 | 1240 | 0.77 | 0.82 | 6 | 1220 | 0.74 | 0.84 | 12 |
| A-5-1 | 1270 | 0.65 | 0.80 | 8 | 1250 | 0.62 | 0.78 | 12 |
| A-5-2 | 1240 | 0.63 | 0.76 | 9 | 1210 | 0.59 | 0.75 | 14 |
| Comparative Examples | | | | | | | | |
| CA-1 | 750 | 0.66 | 0.50 | 0 | 480 | 0.14 | 0.12 | 0 |
| CA-2 | 1120 | 0.60 | 0.60 | 100 | 1240 | 0.46 | 0.15 | 142 |
| CA-3 | 1180 | 0.74 | 0.58 | 0 | 1090 | 0.48 | 0.50 | 0 |
| CA-4 | 820 | 0.56 | 0.40 | 0 | 510 | 0.24 | 0.28 | 0 |
| CA-5 | 1180 | 0.59 | 0.57 | 101 | 1300 | 0.48 | 0.56 | 144 |
| CA-6 | 1040 | 0.62 | 0.56 | 0 | 1060 | 0.50 | 0.53 | 1 |
| CA-7 | 1100 | 0.72 | 1.03 | 0 | 760 | 0.21 | 0.56 | 0 |
| CA-8 | 1380 | 0.82 | 1.24 | 116 | 1480 | 0.42 | 0.78 | 183 |
| CA-9 | 1280 | 0.85 | 1.22 | 0 | 1200 | 0.40 | 0.76 | 6 |
| CA-10 | 810 | 0.34 | 0.37 | 4 | 800 | 0.28 | 0.21 | 3 |
| CA-11 | 1220 | 0.77 | 0.87 | 100 | 1350 | 0.75 | 0.87 | 146 |
| CA-12 | 1010 | 0.42 | 0.47 | 4 | 980 | 0.32 | 0.27 | 10 |
| CA-13 | 1010 | 0.58 | 0.56 | 0 | 970 | 0.34 | 0.42 | 1 |
| CA-14 | 1270 | 0.80 | 0.88 | 103 | 1360 | 0.78 | 0.89 | 151 |
| CA-15 | 910 | 0.62 | 0.59 | 1 | 900 | 0.38 | 0.46 | 5 |
| CA-16 | 1090 | 0.36 | 0.54 | 8 | 940 | 0.30 | 0.45 | 4 |
| CA-17 | 1380 | 0.76 | 0.94 | 98 | 1480 | 0.69 | 0.86 | 150 |
| CA-18 | 1330 | 0.44 | 0.69 | 12 | 1290 | 0.31 | 0.41 | 28 |
| CA-19 | 970 | 0.31 | 0.49 | 6 | 900 | 0.25 | 0.20 | 3 |

EXAMPLE B-1

(1) Preparation of Intermediate Layer Coating Liquid

Resin Liquid 1

Resin Liquid 1 was prepared by mixing the following components:

| | Parts by Weight |
|---|---|
| Polyvinyl butyral (Trademark "BL-1" made by Sekisui Chemical Co., Ltd.) | 8 |
| Cyclohexanone | 92 |

A milling pot made of glass having a diameter of 12 cm was half filled with sintered alumina balls having a diameter of 1 cm.

In this milling pot, 120 g of the above prepared resin solution, 10.5 g of Azo Pigment No. I-5 in Table 1-1, having the following formula,

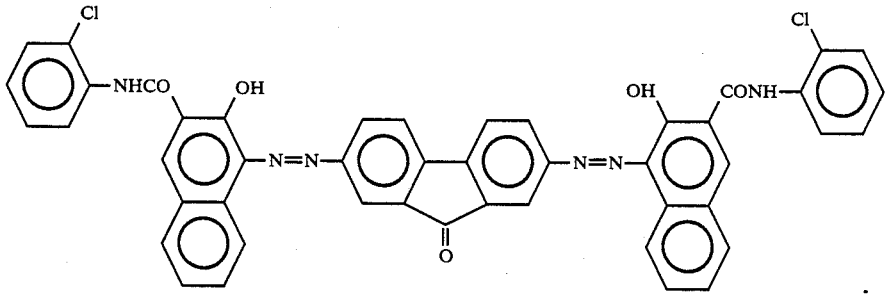

and 100 g of methyl ethyl ketone were placed.

The mixture was then subjected to milling for 72 hours. Thereafter, 220 g of methyl ethyl ketone was added and the milling was continued for another 24 hours. Thus, 420 g of a dispersion was obtained.

To the thus obtained dispersion, 27 g of a TDI solution of the following formulation and 240 g of methyl ethyl ketone were added dropwise, with stirring, whereby an intermediate layer coating liquid was prepared:

| | Parts by Weight |
|---|---|
| Tolylene diisocyanate (TDI) | 10 |
| Methyl ethyl ketone | 90 |

(2) Preparation of Charge Generating Layer Coating Liquid

A milling pot made of glass having a diameter of 15 cm was half filled with stainless steel balls having a diameter of 1 cm. To this milling pot, 400 g of cyclohexanone and 25 g of a Azo Pigment No. I-5 in Table 1-1 were added.

The mixture was milled for 48 hours. To this mixture, 408 g of cyclohexanone was added, and the mixture was further milled for 24 hours, whereby 800 g of a dispersion was obtained.

800 g of tetrahydrofuran was then added dropwise to the above obtained dispersion, whereby a charge generating layer coating liquid was prepared.

(3) Preparation of Charge Transporting Layer Coating Solution

A charge transporting layer coating solution was prepared by mixing the following components:

| | Parts by Weight |
|---|---|
| α-phenylstilbene type charge transporting material having the formula: | 10 |

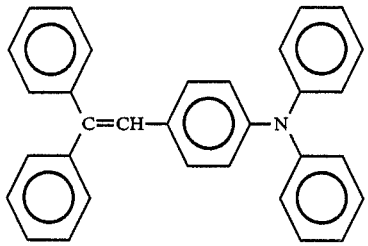

| | |
|---|---|
| Polycarbonate (Trademark "Panlite C-1400" made by Teijin Limited) | 10 |
| Silicone oil (Trademark "KF-50") | 0.0002 |
| Tetrahydrofuran | 80 |

(4) Preparation of Electrophotographic Photoconductor No. B-1 According to the Present Invention An aluminum plate having a thickness of 0.3 mm which was cleaned by a vapor of perchloroethylene.

The thus cleaned aluminum plate was immersed into the above prepared intermediate layer coating liquid, and then pulled out to coat the intermediate layer coating liquid on the aluminum plate. The intermediate layer coating liquid coated aluminum plate was then heated at 130° C. for 1 hour, so that the coated liquid was thermally hardened. Thus an intermediate layer having a thickness of 1.5 μm was formed on the aluminum plate.

The aluminum plate with the intermediate layer formed thereon was then immersed into the above prepared charge generating layer coating liquid and was then pulled out at a speed of 5.0 mm/sec, whereby the charge generating layer coating liquid was coated on the intermediate layer. The thus coated charge generating layer coating liquid was then hardened by the application of heat at 130° C. for 10 minutes, whereby a charge generating layer was formed on the intermediate layer.

The aluminum plate with the intermediate layer and the charge generating layer successively formed thereon was then immersed into the previously prepared charge transporting layer coating liquid and was then pulled out, whereby the charge transporting layer coating liquid was coated on the charge generating layer.

The thus coated charge transporting layer coating liquid was hardened by the application of heat at 130° C. for 1 hour, whereby a charge transporting layer was formed on the charge generating layer.

The entire thickness of the thus formed photoconductive layer consisting of the charge generating layer and the charge transporting layer was 22 μm. Thus an electrophotographic photoconductor No. B-1 according to the present invention was prepared.

COMPARATIVE EXAMPLE CB-1

Example 1 was repeated except that the intermediate layer formed in Example B-1 was eliminated, whereby a comparative electrophotographic photoconductor No. CB-1 was prepared.

COMPARATIVE EXAMPLE CB-2

Example B-1 was repeated except that the intermediate layer coating liquid employed in Example B-1 was replaced by Resin Liquid 2 of the following formulation, and an intermediate layer formed by coating this resin liquid was heated at 130° C. for 1 hour, thereby forming an intermediate layer having a thickness of 1.2 μm, thus a comparative electrophotographic photoconductor No. CB-2 was prepared:

Resin Liquid 2

Resin Liquid 2 was prepared by mixing the following components:

| | Parts by Weight |
|---|---|
| Polyvinyl butyral (Trademark "BL-1" made by Sekisui Chemical Co., Ltd.) | 48 |
| Tolylene diisocyanate (TDI) | 14.5 |
| Cyclohexanone | 552 |
| Methyl ethyl ketone | 130 |

EXAMPLE B-2

(1) Preparation of Intermediate Layer Coating Liquid

The same intermediate layer coating liqiid as that employed in Example B-1 was prepared. (2) Preparation of Charge Generating Layer Coating Liquid A milling pot made of glass having a diameter of 15 cm was half filled with agate balls having a diameter of 1 cm. To this milling pot, 400 g of Resin Liquid 4 of the following formulation and 25 g of Azo Pigment No. CG-2-22 in Table 2-2 were added. The mixture was milled for 48 hours. To this mixture, 580 g of Resin Liquid 4 was further added, and the mixture was further milled for 24 hours, so that 950 g of a dispersion was obtained. To this dispersion, 710 g of methyl ethyl ketone was added dropwise, whereby a charge generating layer coating liquid was prepared.

Resin Liquid 4

Resin Liquid 4 was prepared by mixing the following components:

| | Parts by Weight |
|---|---|
| Polyvinyl butyral (Trademark "XYHL" made by Union Carbide Corp.) | 10 |
| Cyclohexanone | 970 |

(3) Preparation of Charge Transporting Layer Coating Solution

A charge transporting layer coating solution was prepared by mixing the following components:

| | Parts by Weight |
|---|---|
| α-phenylstilbene type charge transporting material having the formula: | 10 |

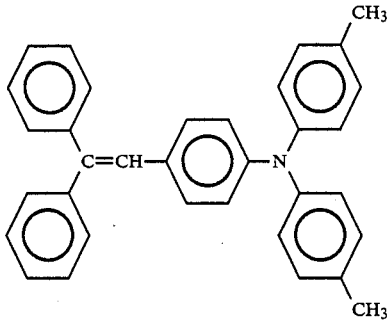

| | |
|---|---|
| Polycarbonate (Trademark "Panlite C-1400" made by Teijin Limited) | 10 |
| Silicone oil (Trademark "KF-50") | 0.0002 |
| Tetrahydrofuran | 80 |

(4) Preparation of Electrophotographic Photoconductor No. B-2 According to the Present Invention An aluminum plate having a thickness of 0.3 mm which was cleaned by a vapor of perchloroethylene.

The thus cleaned aluminum plate was immersed into the above prepared intermediate layer coating liquid, and then pulled out to coat the intermediate layer coating liquid on the aluminum plate. The intermediate layer coating liquid coated aluminum plate was then heated at 130° C. for 1 hour, so that the coated liquid was thermally hardened. Thus an intermediate layer having a thickness of 1.5 μm was formed on the aluminum plate.

The aluminum plate with the intermediate layer formed thereon was then immersed into the above prepared charge generating layer coating liquid and was then pulled out at a speed of 6 mm/sec, whereby the charge generating layer coating liquid was coated on the intermediate layer. The thus coated charge generating layer coating liquid was then hardened by the application of heat at 130° C. for 10 minutes, whereby a charge generating layer was formed on the intermediate layer.

The aluminum plate with the intermediate layer and the charge generating layer successively formed thereon was then immersed into the previously prepared charge transporting layer coating liquid and was then pulled out, whereby the charge transporting layer coating liquid was coated on the charge generating layer.

The thus coated charge transporting layer coating liquid was then hardened by the application of heat at 130° C. for 1 hour, whereby a charge transporting layer was formed on the charge generating layer.

The entire thickness of the thus formed photoconductive layer consisting of the charge generating layer and the charge transporting layer was 22 μm. Thus an electrophotographic photoconductor No. B-2 according to the present invention was prepared.

COMPARATIVE EXAMPLE CB-3

Example B-2 was repeated except that the intermediate layer formed in Example B-2 was eliminated, whereby a comparative electrophotographic photoconductor No. CB-4 was prepared.

COMPARATIVE EXAMPLE CB-4

Example B-2 was repeated except that the intermediate layer coating liquid employed in Example B-2 was replaced by Resin Liquid 2 employed in Comparative Example CB-2, and an intermediate layer formed by coating this resin liquid was heated at 130° C. for 1 hour, thereby forming an intermediate layer having a thickness of 1.2 μm, thus a comparative electrophotographic photoconductor No. CB-4 was prepared.

COMPARATIVE EXAMPLE CB-5

Example B-2 was repeated except that the intermediate layer coating liquid employed in Example B-2 was replaced by Resin Liquid 3 of the following formulation, and an intermediate layer formed by coating this resin liquid was heated at 130° C. for 10 minutes, thereby forming an intermediate layer having a thickness of 1.2 μm, thus a comparative electrophotographic photoconductor No. CB-5 was prepared.

Resin Liquid 3

Resin Liquid 3 was prepared by mixing the following components:

| | Parts by Weight |
|---|---|
| Nylon resin (Trademark "CM-8000" made by Toray Industries, Inc.) | 8 |
| Methanol | 60 |
| Butanol | 32 |

EXAMPLE B-3

(1) Preparation of Intermediate Layer Coating Liquid

The same intermediate layer coating liquid as that employed in Example B-1 was prepared.

(2) Preparation cf Charge Generating Layer Coating Liquid

A milling pot made of glass having a diameter of 15 cm was half filled with sintered alumina balls having a diameter of 1 cm. To this milling pot, 400 g of Resin Liquid 4 employed in Example B-4 and 25 g of Azo Pigment No. CG-3-9 were added. The mixture was then milled for 48 hours. To this mixture, 580 g of Resin Liquid 4 was further added. This mixture was further milled for 24 hours, so that 950 g of a dispersion was obtained. To this dispersion, 710 g of methyl ethyl ketone was added dropwise, whereby a charge generating layer coating liquid was prepared.

(3) Preparation of Charge Transporting Layer Coating Solution

A charge transporting layer coating solution was prepared by mixing the following components:

| | Parts by Weight |
|---|---|
| Hydrazone type charge transporting material having the formula: | 10 |

-continued

| | Parts by Weight |
|---|---|
| 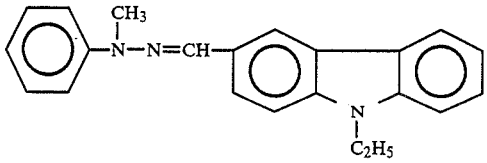 | |
| Polycarbonate (Trademark "Panlite C-1400" made by Teijin Limited) | 10 |
| Silicone oil (Trademark "KF-50") | 0.0002 |
| Tetrahydrofuran | 80 |

(4) Preparation of Electrophotographic Photoconductor No. 3 According to the Present Invention An aluminum plate having a thickness of 0.3 mm which was cleaned by a vapor of perchloroethylene.

The thus cleaned aluminum plate was immersed into the above prepared intermediate layer coating liquid, and then pulled out to coat the intermediate layer coating liquid on the aluminum plate. The intermediate layer coating liquid coated aluminum plate was then heated at 130° C. for 1 hour, so that the coated liquid was thermally hardened. Thus an intermediate layer having a thickness of 1.5 μm was formed on the aluminum plate.

The aluminum plate with the intermediate layer formed thereon was then immersed into the above prepared charge generating layer coating liquid and was then pulled out at a speed of 6 mm/sec, whereby the charge generating layer coating liquid was coated on the intermediate layer. The thus coated charge generating layer coating liquid was then hardened by the application of heat at 130° C. for 10 minutes, whereby a charge generating layer was formed on the intermediate layer.

The aluminum plate with the intermediate layer and the charge generating layer successively formed thereon was then immersed into the previously prepared charge transporting layer coating liquid and was then pulled out, whereby the charge transporting layer coating liquid was coated on the charge generating layer.

The thus coated charge transporting layer coating liquid was then hardened by the application of heat at 130° C. for 1 hour, whereby a charge transporting layer was formed on the charge generating layer.

The entire thickness of the thus formed photoconductive layer consisting of the charge generating layer and the charge transporting layer was 22 μm. Thus an electrophotographic photoconductor No. B-3 according to the present invention was prepared.

COMPARATIVE EXAMPLE CB-6

Example B-3 was repeated except that the intermediate layer formed in Example B-3 was eliminated, whereby a comparative electrophotographic photoconductor No. CB-6 was prepared.

COMPARATIVE EXAMPLE CB-7

Example B-3 was repeated except that the intermediate layer coating liquid employed in Example B-3 was replaced by Resin Liquid 2 employed in Comparative Example CB-2, and an intermediate layer formed by coating this resin liquid was heated at 130° C. for 1 hour, thereby forming an intermediate layer having a thickness of 1.2 μm, thus a comparative electrophotographic photoconductor No. CB-7 was prepared.

COMPARATIVE EXAMPLE CB-8

Example B-3 was repeated except that the intermediate layer coating liquid employed in Example B-3 was replaced by Resin Liquid 3 employed in Comparative Example CB-5, and an intermediate layer formed by coating this resin liquid was heated at 130° C. for 10 minutes, thereby forming an intermediate layer having a thickness of 1.2 μm, thus a comparative electrophotographic photoconductor No. CB-8 was prepared.

EXAMPLE B-4-1

(1) Preparation of Intermediate Layer Coating Liquid

The same intermediate layer coating liquid employed in Example B-1 was prepared.

(2) Preparation of Charge Generating Layer Coating Liquid

Resin Liquid 5

Resin Liquid 5 was prepared by mixing the following components:

| | Parts by Weight |
|---|---|
| Polyvinylcarbazole (Trademark "Luvican") | 5 |
| Tetrahydrofuran | 45 |
| Toluene | 45 |

In a 50 ml. milling container made of glass, 140 g of stainless steel balls having a diameter of 0.36 cm, 1.0 g of the crystalline selenium particles prepared in Example A-4-1, and 12 g of Resin Liquid 5 were placed, and the mixture was milled, whereby a charge generating layer coating liquid was prepared.

(3) Preparation of Charge Transporting Layer Coating Solution

A charge transporting layer coating solution was prepared by mixing the following components:

| | Parts by Weight |
|---|---|
| N,N'—diphenyl-N,N'—bis(2-methylphenyl)-[1,1-biphenyl]-4,4'-diamine | 9 |
| Polycarbonate (Trademark "Panlite C-1400" made by Teijin Limited) | 9 |
| Silicone oil (Trademark "KF-50") | 0.0001 |
| Dichloromethane | 102 |

(4) Preparation of Electrophotographic Photoconductor No. B-4-1 According to the Present Invention An aluminum plate having a thickness of 0.3 mm which was cleaned by a vapor of perchloroethylene.

The thus cleaned aluminum plate was immersed into the above prepared intermediate layer coating liquid, and then pulled out to coat the intermediate layer coating liquid on the aluminum plate. The intermediate layer coating liquid coated aluminum plate was then heated at 130° C. for 1 hour, so that the coated liquid was thermally hardened. Thus an intermediate layer having a thickness of 1.5 μm was formed on the aluminum plate.

The aluminum plate with the intermediate layer formed thereon was then coated with the above prepared charge generating layer coating liquid by a doctor blade and was then dried at 100° C. for 30 minutes, so that a charge generating layer having a thickness of 2 μm was formed on the intermediate layer.

The aluminum plate with the intermediate layer and the charge generating layer successively formed thereon was then coated with the previously prepared charge transporting layer coating liquid by a doctor blade and was then dried at 100° C. for 30 minutes, so that a charge transporting layer having a thickness of 20 μm was formed on the charge generating layer layer. Thus an electrophotographic photoconductor No. B-4-1 according to the present invention was prepared.

EXAMPLE B-4-2

Example B-4-1 was repeated except that the charge transporting material in the formulation of the charge transporting layer coating liquid employed in Example B-4-1 was replaced by the following α-phenylstilbene type charge transporting material which was employed in Example B-1, whereby an electrophotographic photoconductor No. B-4-2 according to the present invention was prepared:

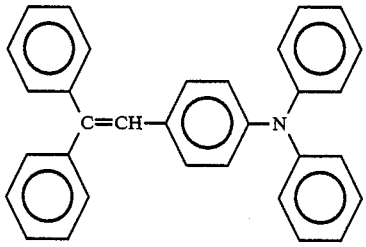

COMPARATIVE EXAMPLE CB-9

Example B-4-1 was repeated except that the intermediate layer formed in Example B-4-1 was eliminated, whereby a comparative electrophotographic photoconductor No. CB-9 was prepared.

COMPARATIVE EXAMPLE CB-10

Example B-4-1 was repeated except that the intermediate layer coating liquid employed in Example B-4-1 was replaced by Resin Liquid 2 employed in Comparative Example CB-2, and an intermediate layer formed by coating this resin liquid was heated at 130° C. for 1 hour, thereby forming an intermediate layer having a thickness of 1.2 μm, whereby a comparative electrophotographic photoconductor No. CB-10 was prepared.

COMPARATIVE EXAMPLE CB-11

Example B-4-1 was repeated except that the intermediate layer coating liquid employed in Example B-4-1 was replaced by Resin Liquid 3 employed in Comparative Example CB-5, and an intermediate layer formed by coating this resin liquid was heated at 130° C. for 10 minutes, thereby forming an intermediate layer having a thickness of 1.2 μm, whereby a comparative electrophotographic photoconductor No. CB-11 was prepared.

COMPARATIVE EXAMPLE CB-12

Example B-4-2 was repeated except that the intermediate layer formed in Example B-4-2 was eliminated, whereby a comparative electrophotographic photoconductor No. CB-12 was prepared.

COMPARATIVE EXMAPLE CB-13

Example B-4-2 was repeated except that the intermediate layer coating liquid employed in Example B-4-2 was replaced by Resin Liquid 2 employed in Comparative Example CB-2, and an intermediate layer formed by coating this resin liquid was heated at 130° C. for 1 hour, thereby forming an intermediate layer having a thickness of 1.2 μm, whereby a comparative electrophotographic photoconductor No. CB-13 was prepared.

COMPARATIVE EXAMPLE CB-14

Example B-4-2 was repeated except that the intermediate layer coating liquid employed in Example B-4-2 was replaced by Resin Liquid 3 employed in Comparative Example CB-2, and an intermediate layer formed by coating this resin liquid was heated at 130° C. for 10 minutes, thereby forming an intermediate layer having a thickness of 1.2 μm, whereby a comparative electrophotographic photoconductor No. CB-13 was prepared.

EXAMPLE B-5-1

(1) Preparation of Intermediate Layer Coating Liquid

The same intermediate layer coating liquid as that employed in Example B-1 was prepared.

(2) Preparation of Charge Generating Layer Coating Liquid

In a 30 ml. milling container made of glass, 70 g of stainless steel balls having a diameter of 0.36 cm, 0.5 g of the finely-divided arsenic selenide particles prepared in Example A-5-1, and 9.5 g of Resin Liquid 5 prepared in Example B-4-1 were placed, and the mixture was milled, whereby a charge generating layer coating liquid was prepared.

(3) Preparation of Charge Transporting Layer Coating Solution

A charge transporting layer coating solution was prepared by mixing the following components:

| | Parts by Weight |
|---|---|
| α-phenylstilbene type charge transporting material having the formula: | 9 |

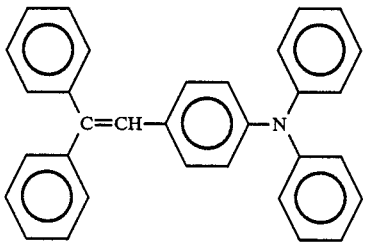

| | |
|---|---|
| Polycarbonate (Trademark "Panlite C-1400" made by Teijin Limited) | 9 |

-continued

| | Parts by Weight |
|---|---|
| Silicone oil (Trademark "KF-50") | 0.0001 |
| Dichloromethane | 102 |

(4) Preparation of Electrophotographic Photoconductor No. B-5-1 According to the Present Invention An aluminum plate having a thickness of 0.3 mm which was cleaned by a vapor of perchloroethylene.

The thus cleaned aluminum plate was immersed into the above prepared intermediate layer coating liquid, and then pulled out to coat the intermediate layer coating liquid on the aluminum plate. The intermediate layer coating liquid coated aluminum plate was then heated at 130° C. for 1 hour, so that the coated liquid was thermally hardened. Thus an intermediate layer having a thickness of 1.5 μm was formed on the aluminum plate.

The aluminum plate with the intermediate layer formed thereon was then coated with the above prepared charge generating layer coating liquid by a doctor blade and was then dried at 100° C. for 30 minutes, so that a charge generating layer having a thickness of 2 μm was formed on the intermediate layer.

The aluminum plate with the intermediate layer and the charge generating layer successively formed thereon was then coated with the previously prepared charge transporting layer coating liquid by a doctor blade and was then dried at 100° C. for 30 minutes, so that a charge transporting layer having a thickness of 20 μm was formed on the charge generating layer layer. Thus an electrophotographic photoconductor No. B-5-1 according to the present invention was prepared.

EXAMPLE B-5-2

Example B-5-1 was repeated except that the charge transporting material in the formulation of the charge transporting layer coating liquid employed in Example B-5-1 was replaced by the charge transporting material, N,N'-diphenyl-N,N'-bis(2-methylphenyl)-[1,1'-biphenyl] -4,4'-diamine, which was employed in Example B-4-1, whereby an electrophotographic photoconductor No. B-5-2 according to the present invention was prepared.

COMPARATIVE EXAMPLE CB-15

Example B-5-1 was repeated except that the intermediate layer formed in Example B-5-1 was eliminated, whereby a comparative electrophotographic photoconductor No. CB-15 was prepared.

COMPARATIVE EXAMPLE CB-16

Example B-5-1 was repeated except that the intermediate layer coating liquid employed in Example B-5-1 was replaced by Resin Liquid 2 employed in Comparative Example CB-2, and an intermediate layer formed by coating this resin liquid was heated at 130° C. for 1 hour, thereby forming an intermediate layer having a thickness of 1.2 μm, whereby a comparative electrophotographic photoconductor No. CB-16 was prepared.

COMPARATIVE EXAMPLE CB-17

Example B-5-1 was repeated except that the intermediate layer coating liquid employed in Example B-5-1 was replaced by Resin Liquid 3 employed in Comparative Example CB-5, and an intermediate layer formed by coating this resin liquid was heated at 130° C. for 10 minutes, thereby forming an intermediate layer having a thickness of 1.2 μm, whereby a comparative electrophotographic photoconductor No. CB-17 was prepared.

COMPARATIVE EXAMPLE CB-18

Example B-5-2 was repeated except that the intermediate layer formed in Example B-5-2 was eliminated, whereby a comparative electrophotographic photoconductor No. CB-18 was prepared.

Each of the thus prepared electrophotographic photoconductors Nos. B-1~B-3, Nos. B-4-1~B-4-2, and Nos. B-5-1~B-5-2 according to the present invention, and the comparative electrophotographic photoconductors Nos. CB-1~CB-18 was negatively charged in the dark under application of −6 kV of corona charge for 20 seconds under the conditions of a temperature of 10° C. and a humidity of 20% (hereinafter referred to as the low temperature and low humidity conditions), and subsequently under the conditions of a temperature of 30° C. and a humidity of 90% (hereinafter referred to as the high temperature and high humidity conditions), so that the respective initial surface potentials $V_i$ at the low temperature and low humidity conditions and at the high temperature and high humidity conditions of each photoconductor were measured by Electrostatic Paper Analyzer (Model SP-428 made by Kawaguchi Electro Works).

Thereafter each photoconductor was allowed to stand in the dark for 20 seconds without applying any charges thereto, so that the corresponding surface potentials $V_{po}$ after dark decay were measured.

Each photoconductor was subsequently illuminated by a tungsten lamp in such a manner that the illuminance on the illuminated surface of the photoconductor was 4.5 lux, so that the exposures $E_{\frac{1}{2}}$ required to respectively reduce the surface potentials $V_{po}$ to $\frac{1}{2}$ of the surface potentials $V_{po}$, and the residual surface potentials $V_e$ after each photoconductor was illuminated by the tungsten lamp for 30 seconds were measured.

In order to assess the durability and fatigue resistance of the photoconductors, each photoconductor was negatively charged in the dark under application of −7.5 kV for 20 seconds and exposed to light of 50 lux in the same manner as mentioned above, and this was repeated for 10 minutes, so that the initial surface potentials $V_i'$, the surface potentials $V_{po}'$ after dark decay, the exposures $E_{\frac{1}{2}}'$, and the residual surface potentials $V_e'$ after fatigued, corresponding to the above $V_i$, $V_{po}$, $E_{\frac{1}{2}}$, and $V_e$, were measured.

The above results are shown in Tables 3B-1 and 3B-2.

TABLE 3B-1

| | Low Temperature & Low Humidity | | | | | | | |
|---|---|---|---|---|---|---|---|---|
| | Before Fatigue | | | | After Fatigue | | | |
| | $V_i$ | $V_{po}/V_i$ | $E_{\frac{1}{2}}$ | $V_e$ | $V_i'$ | $V_{po}'/V_i'$ | $E_{\frac{1}{2}}'$ | $V_e'$ |
| Examples | | | | | | | | |
| B-1 | 1150 | 0.68 | 0.70 | 0 | 1120 | 0.67 | 0.68 | 0 |
| B-2 | 1280 | 0.65 | 0.57 | 0 | 1240 | 0.64 | 0.55 | 3 |
| B-3 | 1360 | 0.82 | 1.16 | 4 | 1330 | 0.78 | 1.12 | 6 |
| B-4-1 | 1180 | 0.75 | 0.75 | 8 | 1150 | 0.70 | 0.74 | 6 |
| B-4-2 | 1220 | 0.76 | 0.78 | 5 | 1200 | 0.74 | 0.77 | 7 |
| B-5-1 | 1290 | 0.65 | 0.79 | 10 | 1250 | 0.63 | 0.80 | 13 |
| B-5-2 | 1250 | 0.61 | 0.75 | 11 | 1190 | 0.57 | 0.77 | 14 |

TABLE 3B-1-continued

| | Low Temperature & Low Humidity | | | | | | | |
|---|---|---|---|---|---|---|---|---|
| | Before Fatigue | | | | After Fatigue | | | |
| | $V_i$ | $V_{po}/V_i$ | $E_{\frac{1}{2}}$ | $V_e$ | $V_i'$ | $V_{po}'/V_i'$ | $E_{\frac{1}{2}}'$ | $V_e'$ |
| Comparative Examples | | | | | | | | |
| CB-1 | 780 | 0.69 | 0.53 | 0 | 540 | 0.18 | 0.30 | 0 |
| CB-2 | 1150 | 0.61 | 0.59 | 102 | 1270 | 0.40 | 0.57 | 192 |
| CB-3 | 980 | 0.62 | 0.50 | 0 | 880 | 0.29 | 0.43 | 0 |
| CB-4 | 1200 | 0.60 | 0.58 | 98 | 1260 | 0.43 | 0.61 | 183 |
| CB-5 | 1410 | 0.77 | 0.60 | 6 | 1430 | 0.80 | 0.95 | 237 |
| CB-6 | 1120 | 0.74 | 1.02 | 0 | 930 | 0.24 | 0.68 | 2 |
| CB-7 | 1410 | 0.89 | 1.22 | 106 | 1500 | 0.68 | 1.02 | 202 |
| CB-8 | 1400 | 0.86 | 1.20 | 8 | 1360 | 0.62 | 0.92 | 208 |
| CB-9 | 960 | 0.39 | 0.48 | 2 | 860 | 0.30 | 0.35 | 3 |
| CB-10 | 1300 | 0.79 | 0.86 | 103 | 1400 | 0.75 | 0.89 | 204 |
| CB-11 | 1150 | 0.53 | 0.56 | 6 | 1140 | 0.41 | 0.49 | 161 |
| CB-12 | 1060 | 0.59 | 0.56 | 1 | 970 | 0.37 | 0.42 | 2 |
| CB-13 | 1330 | 0.81 | 0.89 | 99 | 1440 | 0.76 | 0.92 | 208 |
| CB-14 | 1180 | 0.62 | 0.63 | 3 | 1190 | 0.64 | 0.72 | 142 |
| CB-15 | 1060 | 0.40 | 0.58 | 6 | 1020 | 0.29 | 0.37 | 8 |
| CB-16 | 1440 | 0.76 | 0.95 | 101 | 1530 | 0.69 | 0.90 | 198 |
| CB-17 | 1360 | 0.47 | 0.70 | 19 | 1290 | 0.38 | 0.57 | 180 |
| CB-18 | 990 | 0.36 | 0.57 | 10 | 980 | 0.28 | 0.39 | 12 |

TABLE 3B-2

| | High Temperature & High Humidity | | | | | | | |
|---|---|---|---|---|---|---|---|---|
| | Before Fatigue | | | | After Fatigue | | | |
| | $V_i$ | $V_{po}/V_i$ | $E_{\frac{1}{2}}$ | $V_e$ | $V_i'$ | $V_{po}'/V_i'$ | $E_{\frac{1}{2}}'$ | $V_e'$ |
| Examples | | | | | | | | |
| B-1 | 1100 | 0.65 | 0.67 | 0 | 1080 | 0.61 | 0.64 | 0 |
| B-2 | 1270 | 0.67 | 0.54 | 0 | 1210 | 0.64 | 0.53 | 1 |
| B-3 | 1350 | 0.81 | 1.12 | 2 | 1310 | 0.78 | 1.04 | 3 |
| B-4-1 | 1180 | 0.73 | 0.74 | 2 | 1160 | 0.70 | 0.73 | 1 |
| B-4-2 | 1210 | 0.75 | 0.77 | 2 | 1180 | 0.73 | 0.75 | 1 |
| B-5-1 | 1280 | 0.64 | 0.78 | 6 | 1240 | 0.62 | 0.76 | 9 |
| B-5-2 | 1220 | 0.61 | 0.74 | 4 | 1150 | 0.58 | 0.71 | 8 |
| Comparative Examples | | | | | | | | |
| CB-3 | 820 | 0.56 | 0.40 | 0 | 510 | 0.24 | 0.28 | 0 |
| CB-4 | 1180 | 0.59 | 0.57 | 101 | 1300 | 0.48 | 0.56 | 144 |
| CB-5 | 1040 | 0.62 | 0.56 | 0 | 1060 | 0.50 | 0.53 | 1 |
| CB-6 | 1100 | 0.72 | 1.03 | 0 | 760 | 0.21 | 0.56 | 0 |

TABLE 3B-2-continued

| | High Temperature & High Humidity | | | | | | | |
|---|---|---|---|---|---|---|---|---|
| | Before Fatigue | | | | After Fatigue | | | |
| | $V_i$ | $V_{po}/V_i$ | $E_{\frac{1}{2}}$ | $V_e$ | $V_i'$ | $V_{po}'/V_i'$ | $E_{\frac{1}{2}}'$ | $V_e'$ |
| CB-7 | 1380 | 0.82 | 1.24 | 116 | 1480 | 0.42 | 0.78 | 183 |
| CB-8 | 1280 | 0.85 | 1.22 | 0 | 1200 | 0.40 | 0.76 | 6 |
| CB-9 | 810 | 0.34 | 0.37 | 4 | 800 | 0.28 | 0.21 | 3 |
| CB-10 | 1220 | 0.77 | 0.87 | 100 | 1350 | 0.75 | 0.87 | 146 |
| CB-11 | 1010 | 0.42 | 0.47 | 4 | 980 | 0.32 | 0.27 | 10 |
| CB-12 | 1010 | 0.58 | 0.56 | 0 | 970 | 0.34 | 0.42 | 1 |
| CB-13 | 1270 | 0.80 | 0.88 | 103 | 1360 | 0.78 | 0.89 | 151 |
| CB-14 | 910 | 0.62 | 0.59 | 1 | 900 | 0.38 | 0.46 | 5 |
| CB-15 | 1090 | 0.36 | 0.54 | 8 | 940 | 0.30 | 0.45 | 4 |
| CB-16 | 1380 | 0.76 | 0.94 | 98 | 1480 | 0.69 | 0.86 | 150 |
| CB-17 | 1330 | 0.44 | 0.69 | 12 | 1290 | 0.31 | 0.41 | 28 |
| CB-18 | 970 | 0.31 | 0.49 | 6 | 900 | 0.25 | 0.20 | 3 |

EXAMPLE C-1

(1) Preparation of Intermediate Layer Coating Liquid

Resin Liquid 1

Resin Liquid 1 was prepared by mixing the following components:

| | Parts by Weight |
|---|---|
| Polyvinyl butyral (Trademark "BL-1" made by Sekisui Chemical Co., Ltd.) | 8 |
| Cyclohexanone | 92 |

A milling pot made of glass having a diameter of 12 cm was half filled with sintered alumina balls having a diameter of 1 cm.

In this milling pot, 120 g of the above prepared resin liquid, 100 g of methyl ethyl ketone and 10.5 g of Azo Pigment No. CG-2-22 in Table 2-2 having the following formula were placed:

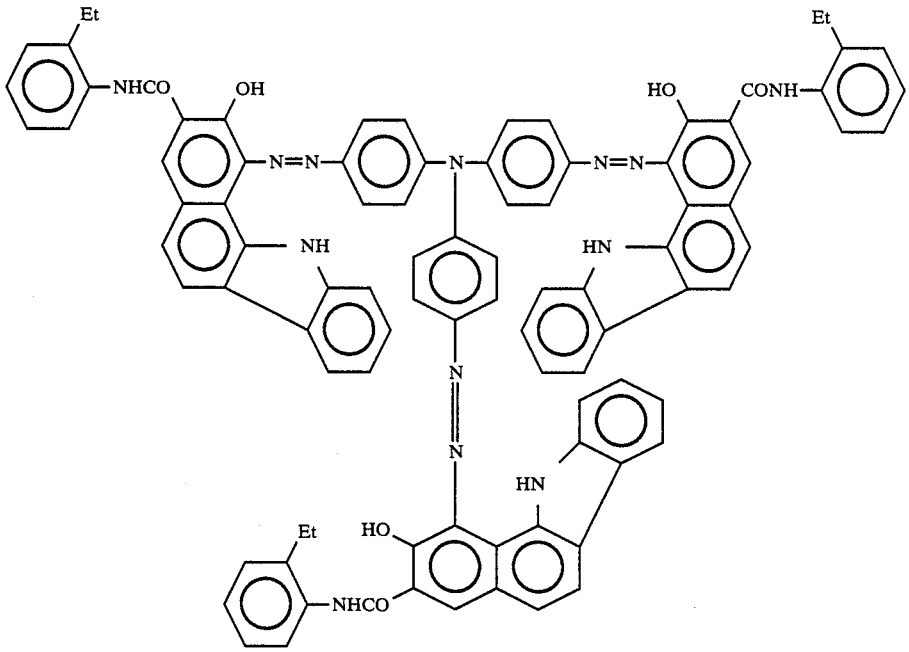

The mixture was then subjected to milling for 72 hours. Thereafter, 120 g of methyl ethyl ketone was added and the milling was continued for another 24 hours. Thus, 280 g of a dispersion was obtained.

To the thus obtained dispersion, 24 g of a TDI solution of the following formulation and 40 g of methyl ethyl ketone were added dropwise, with stirring, whereby an intermediate layer coating liquid was prepared:

| TDI Solution | Parts by Weight |
|---|---|
| Tolylene diisocyanate (TDI) | 10 |
| Methyl ethyl ketone | 90 |

(2) Preparation of Charge Generating Layer Coating Liquid

A milling pot made of glass having a diameter of 15 cm was half filled with stainless steel balls having a diameter of 1 cm. To this milling pot, 400 g of a cyclohexanone solution containing 2.5 wt. % of polyvinyl butyral ("BL-1") and 25 g of Azo Pigment No. CG-1-8 in Table 2-1 were added.

The mixture was milled for 48 hours. To this mixture, 408 g of cyclohexanone was added, and the mixture was further milled for 24 hours, whereby 800 g of a dispersion was obtained.

800 g of tetrahydrofuran was then added dropwise to the above obtained dispersion, whereby a charge generating layer coating liquid was prepared.

(3) Preparation of Charge Transporting Layer Coating Solution

A charge transporting layer coating solution was prepared by mixing the following components

| | Parts by Weight |
|---|---|
| α-phenylstilbene type charge transporting material having the formula: | 10 |

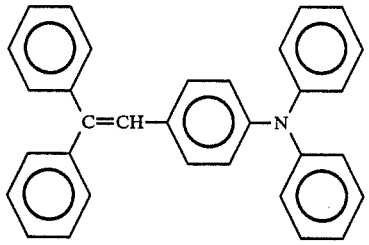

| | |
|---|---|
| Polycarbonate (Trademark "Panlite C-1400" made by Teijin Limited) | 10 |
| Silicone oil (Trademark "KF-50") | 0.0002 |
| Tetrahydrofuran | 80 |

(4) Preparation of Electrophotographic Photoconductor No. C-1 According to the Present Invention An aluminum plate having a thickness of 0.3 mm which was cleaned by a vapor of perchloroethylene.

The thus cleaned aluminum plate was immersed into the above prepared intermediate layer coating liquid, and then pulled out to coat the intermediate layer coating liquid on the aluminum plate. The intermediate layer coating liquid coated aluminum plate was then heated at 130° C. for 1 hour, so that the coated liquid was thermally hardened. Thus an intermediate layer having a thickness of 1.5 μm was formed on the aluminum plate.

The aluminum plate with the intermediate layer formed thereon was then immersed into the above prepared charge generating layer coating liquid and was then pulled out at a speed of 5.0 mm/sec, whereby the charge generating layer coating liquid was coated on the intermediate layer. The thus coated charge generating layer coating liquid was then hardened by the application of heat at 130° C. for 10 minutes, whereby a charge generating layer was formed on the intermediate layer.

The aluminum plate with the intermediate layer and the charge generating layer successively formed thereon was then immersed into the previously prepared charge transporting layer coating liquid and was then pulled out, whereby the charge transporting layer coating liquid was coated on the charge generating layer.

The thus coated charge transporting layer coating liquid was hardened by the application of heat at 130° C. for 1 hour, whereby a charge transporting layer was formed on the charge generating layer.

The entire thickness of the thus formed photoconductive layer consisting of the charge generating layer and the charge transporting layer was 22 μm. Thus an electrophotographic photoconductor No. C-1 according to the present invention was prepared.

COMPARATIVE EXAMPLE CC-1

Example C-1 was repeated except that the intermediate layer formed in Example C-1 was eliminated, whereby a comparative electrophotographic photoconductor No. CC-1 was prepared.

COMPARATIVE EXAMPLE CC-2

Example C-1 was repeated except that the intermediate layer coating liquid employed in Example C-1 was replaced by Resin Liquid 2 of the following formulation, and an intermediate layer formed by coating this resin liquid was heated at 130° C. for 1 hour, thereby forming an intermediate layer having a thickness of 1.2 μm, thus a comparative electrophotographic photoconductor No. CC-2 was prepared:

Resin Liquid 2

Resin Liquid 2 was prepared by mixing the following components:

| | Parts by Weight |
|---|---|
| Polyvinyl butyral (Trademark "BL-1" made by Sekisui Chemical Co., Ltd.) | 48 |
| Tolylene diisocyanate (TDI) | 14.5 |
| Cyclohexanone | 552 |
| Methyl ethyl ketone | 130 |

COMPARATIVE EXAMPLE CC-3

Example C-1 was repeated except that the intermediate layer coating liquid employed in Example C-1 was replaced by Resin Liquid 3 of the following formulation, and an intermediate layer formed by coating this resin liquid was heated at 130° C. for 10 minutes, thereby forming an intermediate layer having a thickness of 1.2 μm, thus a comparative electrophotographic photoconductor No. CC-3 was prepared:

Resin Liquid 3

Resin Liquid 3 was prepared by mixing the following components:

| | Parts by Weight |
|---|---|
| Nylon resin (Trademark "CM-8000" made by Toray Industries, Inc.) | 8 |
| Methanol | 60 |
| Butanol | 32 |

EXAMPLE C-2

(1) Preparation of Intermediate Layer Coating Liquid

The same intermediate layer coating liquid as that employed in Example C-1 was prepared.

(2) Preparation of Charge Generating Layer Coating Liquid

A milling pot made of glass having a diameter of 15 cm was half filled with agate balls having a diameter of 1 cm. To this milling pot, 400 g of Resin Liquid 4 of the following formulation and 25 g of Azo Pigment No. CG-2-22 in Table 2-2, which is the same azo pigment as that employed in Example C-1, were added. The mixture was milled for 48 hours. To this mixture, 580 g of Resin Liquid 4 of the following formulation was further added, and the mixture was further milled for 24 hours, so that 950 g of a dispersion was obtained. To this dispersion, 710 g of methyl ethyl ketone was added dropwise, whereby a charge generating layer coating liquid was prepared.

Resin Liquid 4

Resin Liquid 4 was prepared by mixing the following components:

| | Parts by Weight |
|---|---|
| Polyvinyl butyral (Trademark "XYHL" made by Union Carbide Corp.) | 10 |
| Cyclohexanone | 970 |

(3) Preparation of Charge Transporting Layer Coating Solution

A charge transporting layer coating solution was prepared by mixing the following components:

| | Parts by Weight |
|---|---|
| α-phenylstilbene type charge transporting material having the formula: | 10 |

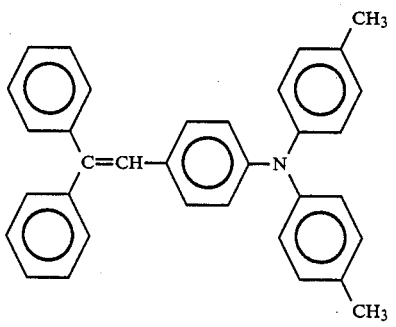

-continued

| | Parts by Weight |
|---|---|
| Polycarbonate (Trademark "Panlite C-1400" made by Teijin Limited) | 10 |
| Silicone oil (Trademark "KF-50") | 0.0002 |
| Tetrahydrofuran | 80 |

(4) Preparation of Electrophotographic Photoconductor No. C-2 According to the Present Invention An aluminum plate having a thickness of 0.3 mm which was cleaned by a vapor of perchloroethylene.

The thus cleaned aluminum plate was immersed into the above prepared intermediate layer coating liquid, and then pulled out to coat the intermediate layer coating liquid on the aluminum plate. The intermediate layer coating liquid coated aluminum plate was then heated at 130° C. for 1 hour, so that the coated liquid was thermally hardened. Thus an intermediate layer having a thickness of 1.5 μm was formed on the aluminum plate.

The aluminum plate with the intermediate layer formed thereon was then immersed into the above prepared charge generating layer coating liquid and was then pulled out at a speed of 6 mm/sec, whereby the charge generating layer coating liquid was coated on the intermediate layer. The thus coated charge generating layer coating liquid was then hardened by the application of heat at 130° C. for 10 minutes, whereby a charge generating layer was formed on the intermediate layer.

The aluminum plate with the intermediate layer and the charge generating layer successively formed thereon was then immersed into the previously prepared charge transporting layer coating liquid and was then pulled out, whereby the charge transporting layer coating liquid was coated on the charge generating layer.

The thus coated charge transporting layer coating liquid was then hardened by the application of heat at 130° C. for 1 hour, whereby a charge transporting layer was formed on the charge generating layer.

The entire thickness of the thus formed photoconductive layer consisting of the charge generating layer and the charge transporting layer was 22 μm. Thus an electrophotographic photoconductor No. C-2 according to the present invention was prepared.

COMPARATIVE EXAMPLE CC-4

Example C-2 was repeated except that the intermediate layer formed in Example C-2 was eliminated, whereby a comparative electrophotographic photoconductor No. CC-4 was prepared.

COMPARATIVE EXAMPLE CC-5

Example C-2 was repeated except that the intermediate layer coating liquid employed in Example C-2 was replaced by Resin Liquid 2 employed in Comparative Example CC-2, and an intermediate layer formed by coating this resin liquid was heated at 130° C. for 1 hour, thereby forming an intermediate layer having a thickness of 1.2 μm, thus a comparative electrophotographic photoconductor No. CC-5 was prepared.

COMPARATIVE EXAMPLE CC-6

Example C-2 was repeated except that the intermediate layer coating liquid employed in Example C-2 was replaced by Resin Liquid 3 employed in Comparative Example CC-3, and an intermediate layer formed by coating this resin liquid was heated at 130° C. for 10 minutes, thereby forming an intermediate layer having a thickness of 1.2 μm, thus a comparative electrophotographic photoconductor No. CC-6 was prepared.

EXAMPLE C-3

(1) Preparation of Intermediate Layer Coating Liquid

The same intermediate layer coating employed in Example C-1 was prepared.

(2) Preparation of Charge Generating Layer Coating Liquid

A milling pot made of glass having a diameter of 15 cm was half filled with sintered alumina balls having a diameter of 1 cm. To this milling pot, 400 g of Resin Liquid 4 employed in Example C-2 and 25 g of Azo Pigment No. CG-3-9 were added. The mixture was then milled for 48 hours. To this mixture, 580 g of Resin Liquid 4 was further added. This mixture was further milled for 24 hours, so that 950 g of a dispersion was obtained. To this dispersion, 710 g of methyl ethyl ketone was added dropwise, whereby a charge generating layer coating liquid was prepared.

(3) Preparation of Charge Transporting Layer Coating Solution

A charge transporting layer coating solution was prepared by mixing the following components:

| | Parts by Weight |
|---|---|
| Hydrazone type charge transporting material having the formula: | 10 |

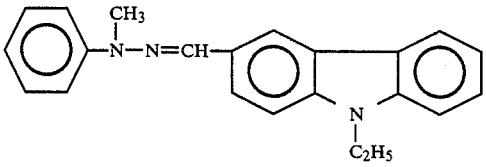

| | |
|---|---|
| Polycarbonate (Trademark "Panlite C-1400" made by Teijin Limited) | 10 |
| Silicone oil (Trademark "KF-50") | 0.0002 |
| Tetrahydrofuran | 80 |

(4) Preparation of Electrophotographic Photoconductor No. C-3 According to the Present Invention An aluminum plate having a thickness of 0.3 mm which was cleaned by a vapor of perchloroethylene.

The thus cleaned aluminum plate was immersed into the above prepared intermediate layer coating liquid, and then pulled out to coat the intermediate layer coating liquid on the aluminum plate. The intermediate layer coating liquid coated aluminum plate was then heated at 130° C. for 1 hour, so that the coated liquid was thermally hardened. Thus an intermediate layer having a thickness of 1.5 μm was formed on the aluminum plate.

The aluminum plate with the intermediate layer formed thereon was then immersed into the above prepared charge generating layer coating liquid and was then pulled out at a speed of 6 mm/sec, whereby the charge generating layer coating liquid was coated on the intermediate layer. The thus coated charge generating layer coating liquid was then hardened by the application of heat at 130° C. for 10 minutes, whereby a charge generating layer was formed on the intermediate layer.

The aluminum plate with the intermediate layer and the charge generating layer successively formed thereon was then immersed into the previously prepared charge transporting layer coating liquid and was then pulled out, whereby the charge transporting layer coating liquid was coated on the charge generating layer.

The thus coated charge transporting layer coating liquid was then hardened by the application of heat at 130° C. for 1 hour, whereby a charge transporting layer was formed on the charge generating layer.

The entire thickness of the thus formed photoconductive layer consisting of the charge generating layer and the charge transporting layer was 22 μm. Thus an electrophotographic photoconductor No. C-3 according to the present invention was prepared.

COMPARATIVE EXAMPLE CC-7

Example C-3 was repeated except that the intermediate layer formed in Example C-3 was eliminated, whereby a comparative electrophotographic photoconductor No. CC-7 was prepared.

COMPARATIVE EXAMPLE CC-8

Example C-3 was repeated except that the intermediate layer coating liquid employed in Example C-3 was replaced by Resin Liquid 2 employed in Comparative Example CC-2, and an intermediate layer formed by coating this resin liquid was heated at 130° C. for 1 hour, thereby forming an intermediate layer having a thickness of 1.2 μm, thus a comparative electrophotographic photoconductor No. CC-8 was prepared.

COMPARATIVE EXAMPLE CC-9

Example C-3 was repeated except that the intermediate layer coating liquid employed in Example C-3 was replaced by Resin Liquid 3 employed in Comparative Example CC-3, and an intermediate layer formed by coating this resin liquid was heated at 130° C. for 10 minutes, thereby forming an intermediate layer having a thickness of 1.2 μm, thus a comparative electrophotographic photoconductor No. CC-9 was prepared.

EXAMPLE C-4-1

(1) Preparation of Intermediate Layer Coating Liquid

The same intermediate layer coating liquid employed in Example C-1 was prepared.

(2) Preparation of Charge Generating Layer Coating Liquid

Resin Liquid 5

Resin Liquid 5 was prepared by mixing the following components:

| | Parts by Weight |
|---|---|
| Polyvinylcarbazole (Trademark "Luvican") | 5 |
| Tetrahydrofuran | 45 |
| Toluene | 45 |

In a 50 ml. milling container made of glass, 140 g of stainless steel balls having a diameter of 0.36 cm, 1.0 g of the crystalline selenium particles prepared in Example C-4-1, and 12 g of Resin Liquid 5 were placed, and the mixture was milled, whereby a charge generating layer coating liquid was prepared.

(3) Preparation of Charge Transporting Layer Coating Solution

A charge transporting layer coating solution was prepared by mixing the following components:

| | Parts by Weight |
|---|---|
| N,N'—diphenyl-N,N'—bis(2-methylphenyl)-[1,1-biphenyl]-4,4'-diamine | 9 |
| Polycarbonate (Trademark "Panlite C-1400" made by Teijin Limited) | 9 |
| Silicone oil (Trademark "KF-50") | 0.0001 |
| Dichloromethane | 102 |

(4) Preparation of Electrophotographic Photoconductor No. C-4-1 According to the Present Invention An aluminum plate having a thickness of 0.3 mm which was cleaned by a vapor of perchloroethylene.

The thus cleaned aluminum plate was immersed into the above prepared intermediate layer coating liquid, and then pulled out to coat the intermediate layer coating liquid on the aluminum plate. The intermediate layer coating liquid coated aluminum plate was then heated at 130° C. for 1 hour, so that the coated liquid was thermally hardened. Thus an intermediate layer having a thickness of 1.5 μm was formed on the aluminum plate.

The aluminum plate with the intermediate layer formed thereon was then coated with the above prepared charge generating layer coating liquid by a doctor blade and was then dried at 100° C. for 30 minutes, so that a charge generating layer having a thickness of 2 μm was formed on the intermediate layer.

The aluminum plate with the intermediate layer and the charge generating layer successively formed thereon was then coated with the previously prepared charge transporting layer coating liquid by a doctor blade and was then dried at 100° C. for 30 minutes, so that a charge transporting layer having a thickness of 20 μm was formed on the charge generating layer layer. Thus an electrophotographic photoconductor No. C-4-1 according to the present invention was prepared.

EXAMPLE C-4-2

Example C-4-1 was repeated except that the charge transporting material in the formulation of the charge transporting layer coating liquid employed in Example B-4-1 was replaced by the following α-phenylstilbene type charge transporting material which was employed in Example C-1, whereby an electrophotographic photoconductor No. C-4-2 according to the present invention was prepared:

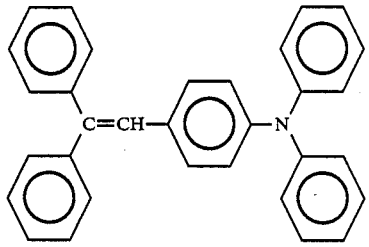

COMPARATIVE EXAMPLE CC-10

Example C-4-1 was repeated except that the intermediate layer formed in Example C-4-1 was eliminated, whereby a comparative electrophotographic photoconductor No. CC-10 was prepared.

COMPARATIVE EXAMPLE CC-11

Example C-4-1 was repeated except that the intermediate layer coating liquid employed in Example C-4-1 was replaced by Resin Liquid 2 employed in Comparative Example CC-2, and an intermediate layer formed by coating this resin liquid was heated at 130° C. for 1 hour, thereby forming an intermediate layer having a thickness of 1.2 μm, whereby a comparative electrophotographic photoconductor No. CC-11 was prepared.

COMPARATIVE EXAMPLE CC-12

Example C-4-1 was repeated except that the intermediate layer coating liquid employed in Example C-4-1 was replaced by Resin Liquid 3 employed in Comparative Example CC-3, and an intermediate layer formed by coating this resin liquid was heated at 130° C. for 10 minutes, thereby forming an intermediate layer having a thickness of 1.2 μm, whereby a comparative electrophotographic photoconductor No. CC-12 was prepared.

COMPARATIVE EXAMPLE CC- 13

Example C-4-2 was repeated except that the intermediate layer formed in Example C-4-2 was eliminated, whereby a comparative electrophotographic photoconductor No. CC-13 was prepared.

COMPARATIVE EXAMPLE CC-14

Example C-4-2 was repeated except that the intermediate layer coating liquid employed in Example C-4-2 was replaced by Resin Liquid 2 employed in Comparative Example CC-2, and an intermediate layer formed by coating this resin liquid was heated at 130° C. for 1 hour, thereby forming an intermediate layer having a thickness of 1.2 μm, whereby a comparative electrophotographic photoconductor No. CC-14 was prepared.

COMPARATIVE EXAMPLE CC-15

Example C-4-2 was repeated except that the intermediate layer coating liquid employed in Example C-4-2 was replaced by Resin Liquid 3 employed in Comparative Example CC-3, and an intermediate layer formed by coating this resin liquid was heated at 130° C. for 10 minutes, thereby forming an intermediate layer having a thickness of 1.2 μm, whereby a comparative electrophotographic photoconductor No. CC-15 was prepared.

EXAMPLE C-5-1

(1) Preparation of Intermediate Layer Coating Liquid

The same intermediate layer coating liquid as that employed in Example C-1 was prepared

(2) Preparation of Charge Generating Layer Coating Liquid

In a 30 ml. milling container made of glass, 70 g of stainless steel balls having a diameter of 0.36 cm, 0.5 g of the finely-divided arsenic selenide particles prepared in Example A-5-1, and 9.5 g of Resin Liquid 5 prepared in Example C-4-1 were placed, and the mixture was milled, whereby a charge generating layer coating liquid was prepared.

(3) Preparation of Charge Transporting Layer Coating Solution

A charge transporting layer coating solution was prepared by mixing the following components:

| | Parts by Weight |
|---|---|
| α-phenylstilbene type charge transporting material having the formula: | 9 |

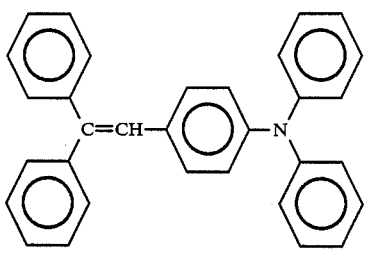

| | |
|---|---|
| Polycarbonate (Trademark "Panlite C-1400" made by Teijin Limited) | 9 |
| Silicone oil (Trademark "KF-50") | 0.0001 |
| Dichloromethane | 102 |

(4) Preparation of Electrophotographic Photoconductor No. C-5-1 According to the Present Invention An aluminum plate having a thickness of 0.3 mm which was cleaned by a vapor of perchloroethylene.

The thus cleaned aluminum plate was immersed into the above prepared intermediate layer coating liquid, and then pulled out to coat the intermediate layer coating liquid on the aluminum plate. The intermediate layer coating liquid coated aluminum plate was then heated at 130° C. for 1 hour, so that the coated liquid was thermally hardened. Thus an intermediate layer having a thickness of 1.5 μm was formed on the aluminum plate.

The aluminum plate with the intermediate layer formed thereon was then coated with the above prepared charge generating layer coating liquid by a doctor blade and was then dried at 100° C. for 30 minutes, so that a charge generating layer having a thickness of 2 μm was formed on the intermediate layer.

The aluminum plate with the intermediate layer and the charge generating layer successively formed thereon was then coated with the previously prepared charge transporting layer coating liquid by a doctor blade and was then dried at 100° C. for 30 minutes, so that a charge transporting layer having a thickness of 20 μm was formed on the charge generating layer layer. Thus an electrophotographic photoconductor No. C-5-1 according to the present invention was prepared.

EXAMPLE C-5-2

Example C-5-1 was repeated except that the charge transporting material in the formulation of the charge transporting layer coating liquid employed in Example C-5-1 was replaced by the charge transporting material, N,N'-diphenyl-N,N'-bis(2-methylphenyl)-[1,1'-biphenyl]-4,4'-diamine, which was employed in Example C-4-1, whereby an electrophotographic photoconductor No. C-5-2 according to the present invention was prepared.

COMPARATIVE EXAMPLE CC-16

Example C-5-1 was repeated except that the intermediate layer formed in Example C-5-1 was eliminated, whereby a comparative electrophotographic photoconductor No. CC-16 was prepared.

COMPARATIVE EXAMPLE CC-17

Example C-5-1 was repeated except that the intermediate layer coating liquid employed in Example C-5-1 was replaced by Resin Liquid 2 employed in Comparative Example CC-2, and an intermediate layer formed by coating this resin liquid was heated at 130° C. for 1 hour, thereby forming an intermediate layer having a thickness of 1.2 μm, whereby a comparative electrophotographic photoconductor No. CC-17 was prepared.

COMPARATIVE EXAMPLE CC-18

Example C-5-1 was repeated except that the intermediate layer coating liquid employed in Example C-5-1 was replaced by Resin Liquid 3 employed in Comparative Example CC-3, and an intermediate layer formed by coating this resin liquid was heated at 130° C. for 10 minutes, thereby forming an intermediate layer having a thickness of 1.2 μm, whereby a comparative electrophotographic photoconductor No. CC-18 was prepared.

COMPARATIVE EXAMPLE CC-19

Example A-5-2 was repeated except that the intermediate layer formed in Example C-5-2 was eliminated, whereby a comparative electrophotographic photoconductor No. CC-19 was prepared.

Each of the thus prepared electrophotographic photoconductors Nos. C-1~C-3, Nos. C-4-1~C-4-2, and Nos. C-5-1~C-5-2 according to the present invention, and the comparative electrophotographic photoconductors Nos. CC-1~CC-19 was negatively charged in the dark under application of −6 kV of corona charge for 20 seconds under the conditions of a temperature of 10° C. and a humidity of 20% (hereinafter referred to as the low temperature and low humidity conditions), and subsequently under the conditions of a temperature of 30° C. and a humidity of 90% (hereinafter referred to as the high temperature and high humidity conditions), so that the respective initial surface potentials $V_i$ at the low temperature and low humidity conditions and at the high temperature and high humidity conditions of each photoconductor were measured by Electrostatic Paper Analyzer (Model SP-428 made by Kawaguchi Electro Works).

Thereafter each photoconductor was allowed to stand in the dark for 20 seconds without applying any charges thereto, so that the corresponding surface potentials $V_{po}$ after dark decay were measured.

Each photoconductor was subsequently illuminated by a tungsten lamp in such a manner that the illuminance on the illuminated surface of the photoconductor was 4.5 lux, so that the exposures $E_{\frac{1}{2}}$ required to respectively reduce the surface potentials $V_{po}$ to $\frac{1}{2}$ of the surface potentials $V_{po}$, and the residual surface potentials $V_e$ after each photoconductor was illuminated by the tungsten lamp for 30 seconds were measured.

In order to assess the durability and fatigue resistance of the photoconductors, each photoconductor was negatively charged in the dark under application of −7.5 kV for 20 seconds and exposed to light of 50 lux in the same manner as mentioned above, and this was repeated for 10 minutes, so that the initial surface potentials $V_i'$, the surface potentials $V_{po}'$ after dark decay, the exposures $E_{\frac{1}{2}}'$, and the residual surface potentials $V_e'$ after fatigued, corresponding to the above $V_i$, $V_{po}$, $E_{\frac{1}{2}}$, and $V_e$, were measured.

The above results are shown in Tables 3C-1 and 3C-2.

TABLE 3C-1

| | Low Temperature & Low Humidity | | | | | | | |
|---|---|---|---|---|---|---|---|---|
| | Before Fatigue | | | | After Fatigue | | | |
| | $V_i$ | $V_{po}/V_i$ | $E_{\frac{1}{2}}$ | $V_e$ | $V_i'$ | $V_{po}'/V_i'$ | $E_{\frac{1}{2}}'$ | $V_e'$ |
| Examples | | | | | | | | |
| C-1 | 1130 | 0.68 | 0.75 | 0 | 1120 | 0.66 | 0.73 | 1 |
| C-2 | 1370 | 0.71 | 0.56 | 0 | 1360 | 0.69 | 0.52 | 1 |
| C-3 | 1370 | 0.83 | 1.18 | 6 | 1210 | 0.74 | 0.78 | 8 |
| C-4-1 | 1200 | 0.73 | 0.75 | 8 | 1180 | 0.68 | 0.73 | 9 |
| C-4-2 | 1220 | 0.76 | 0.79 | 6 | 1210 | 0.74 | 0.78 | 8 |
| C-5-1 | 1300 | 0.65 | 0.79 | 12 | 1240 | 0.61 | 0.81 | 14 |
| C-5-2 | 1280 | 0.62 | 0.74 | 9 | 1200 | 0.56 | 0.75 | 11 |
| Comparative Examples | | | | | | | | |
| CC-1 | 780 | 0.69 | 0.53 | 0 | 540 | 0.18 | 0.30 | 0 |
| CC-2 | 1150 | 0.61 | 0.59 | 102 | 1270 | 0.40 | 0.57 | 192 |
| CC-3 | 1280 | 0.76 | 0.58 | 2 | 1310 | 0.70 | 0.60 | 163 |
| CC-4 | 980 | 0.62 | 0.50 | 0 | 880 | 0.29 | 0.43 | 0 |
| CC-5 | 1200 | 0.60 | 0.58 | 98 | 1260 | 0.43 | 0.61 | 183 |
| CC-6 | 1410 | 0.77 | 0.60 | 6 | 1430 | 0.80 | 0.95 | 237 |
| CC-7 | 1120 | 0.74 | 1.02 | 0 | 930 | 0.24 | 0.68 | 2 |
| CC-8 | 1410 | 0.89 | 1.22 | 106 | 1500 | 0.68 | 1.02 | 202 |
| CC-9 | 1400 | 0.86 | 1.20 | 8 | 1360 | 0.62 | 0.90 | 208 |
| CC-10 | 960 | 0.39 | 0.48 | 2 | 860 | 0.30 | 0.35 | 3 |
| CC-11 | 1300 | 0.79 | 0.86 | 103 | 1400 | 0.75 | 0.89 | 204 |
| CC-12 | 1150 | 0.53 | 0.56 | 6 | 1140 | 0.41 | 0.49 | 161 |
| CC-13 | 1060 | 0.59 | 0.56 | 1 | 970 | 0.37 | 0.42 | 2 |
| CC-14 | 1330 | 0.81 | 0.89 | 99 | 1440 | 0.76 | 0.92 | 208 |
| CC-15 | 1180 | 0.62 | 0.63 | 3 | 1190 | 0.64 | 0.72 | 142 |
| CC-16 | 1060 | 0.40 | 0.58 | 6 | 1020 | 0.29 | 0.37 | 8 |
| CC-17 | 1440 | 0.76 | 0.95 | 101 | 1530 | 0.69 | 0.90 | 198 |
| CC-18 | 1360 | 0.47 | 0.70 | 19 | 1290 | 0.38 | 0.57 | 180 |
| CC-19 | 990 | 0.36 | 0.52 | 10 | 980 | 0.28 | 0.30 | 12 |

TABLE 3C-2

| | High Temperature & High Humidity | | | | | | | |
|---|---|---|---|---|---|---|---|---|
| | Before Fatigue | | | | After Fatigue | | | |
| | $V_i$ | $V_{po}/V_i$ | $E_{\frac{1}{2}}$ | $V_e$ | $V_i'$ | $V_{po}'/V_i'$ | $E_{\frac{1}{2}}'$ | $V_e'$ |
| Examples | | | | | | | | |
| C-1 | 1080 | 0.65 | 0.72 | 0 | 1020 | 0.62 | 0.69 | 0 |
| C-2 | 1270 | 0.66 | 0.55 | 0 | 1230 | 0.63 | 0.54 | 0 |
| C-3 | 1370 | 0.83 | 1.16 | 5 | 1340 | 0.76 | 1.00 | 4 |
| C-4-1 | 1190 | 0.72 | 0.74 | 3 | 1160 | 0.69 | 0.72 | 1 |
| C-4-2 | 1230 | 0.76 | 0.79 | 2 | 1220 | 0.73 | 0.75 | 1 |

TABLE 3C-2-continued

| | High Temperature & High Humidity | | | | | | | |
|---|---|---|---|---|---|---|---|---|
| | Before Fatigue | | | | After Fatigue | | | |
| | $V_i$ | $V_{po}/V_i$ | $E_{\frac{1}{2}}$ | $V_e$ | $V_i'$ | $V_{po}'/V_i'$ | $E_{\frac{1}{2}}'$ | $V_e'$ |
| C-5-1 | 1290 | 0.66 | 0.80 | 6 | 1230 | 0.63 | 0.77 | 10 |
| C-5-2 | 1250 | 0.60 | 0.75 | 5 | 1170 | 0.56 | 0.73 | 7 |
| Comparative Examples | | | | | | | | |
| CC-1 | 750 | 0.66 | 0.50 | 0 | 480 | 0.14 | 0.12 | 0 |
| CC-2 | 1120 | 0.60 | 0.60 | 100 | 1240 | 0.46 | 0.55 | 142 |
| CC-3 | 1180 | 0.74 | 0.58 | 0 | 1090 | 0.48 | 0.50 | 1 |
| CC-5 | 1180 | 0.59 | 0.57 | 101 | 1300 | 0.48 | 0.56 | 144 |
| CC-6 | 1040 | 0.62 | 0.56 | 0 | 1060 | 0.50 | 0.53 | 1 |
| CC-7 | 1100 | 0.72 | 1.03 | 0 | 760 | 0.21 | 0.56 | 0 |
| CC-8 | 1380 | 0.82 | 1.24 | 116 | 1480 | 0.42 | 0.78 | 183 |
| CC-9 | 1280 | 0.85 | 1.22 | 0 | 1200 | 0.40 | 0.76 | 6 |
| CC-10 | 810 | 0.34 | 0.37 | 4 | 800 | 0.28 | 0.21 | 3 |
| CC-11 | 1220 | 0.77 | 0.87 | 100 | 1350 | 0.75 | 0.87 | 146 |
| CC-12 | 1010 | 0.42 | 0.47 | 4 | 980 | 0.32 | 0.27 | 10 |
| CC-13 | 1010 | 0.58 | 0.56 | 0 | 970 | 0.34 | 0.42 | 1 |
| CC-14 | 1270 | 0.80 | 0.88 | 103 | 1360 | 0.78 | 0.89 | 151 |
| CC-15 | 910 | 0.62 | 0.59 | 1 | 900 | 0.38 | 0.46 | 5 |
| CC-16 | 1090 | 0.36 | 0.54 | 8 | 940 | 0.30 | 0.45 | 4 |
| CC-17 | 1380 | 0.76 | 0.94 | 98 | 1480 | 0.69 | 0.69 | 150 |
| CC-18 | 1330 | 0.44 | 0.69 | 12 | 1290 | 0.31 | 0.31 | 28 |
| CC-19 | 970 | 0.31 | 0.49 | 6 | 900 | 0.25 | 0.25 | 3 |

What is claimed is:

1. An electrophotographic photoconductor comprising an electroconductive substrate, an intermediate layer comprising a charge generating azo pigment and a thermosetting resin, a charge generating layer comprising a charge generating material, and a charge transporting layer comprising a charge transporting material, which layers are successively overlaid said electroconductive substrate, said charge generating azo pigment being selected from the group consisting of azo pigments (1) through (4):

azo pigment (1): (I)

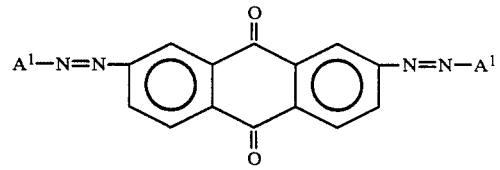

azo pigment (2): (II)

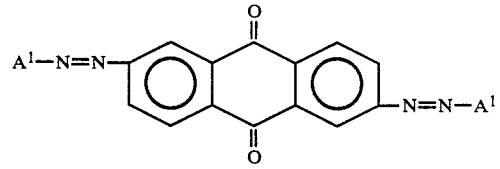

azo pigment (3): (III)

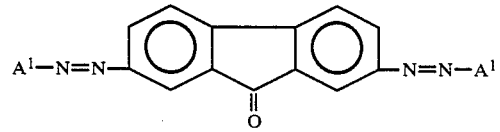

wherein $A^1$ represents a moiety selected from the group consisting of:

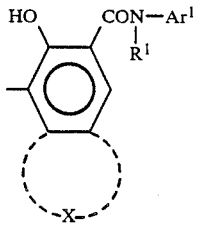
(A-1)

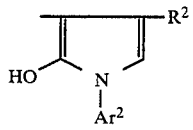
(A-2)

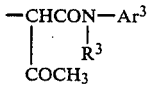
(A-3)

wherein X represents a member selected from the group consisting of an aromatic ring and a heterocyclic ring, each of which may have a substituent, $Ar^1$ represents a member selected from the group consisting of an aromatic ring and a heterocyclic ring, which may have a substituent, $Ar^2$ and $Ar^3$ each represent an aromatic ring, which may have a substituent, $R^1$ and $R^3$ each represent a member selected from the group consisting of hydrogen, an alkyl group having 1 to 4 carbon atoms, which may have a substituent, and a phenyl group which may have a substituent, and $R^2$ represents a member selected from the group consisting of an alkyl group having 1 to 4 carbon atoms, a phenyl group which may have a substituent, and a carboxyl group or an ester group thereof;

Azo pigment (4):

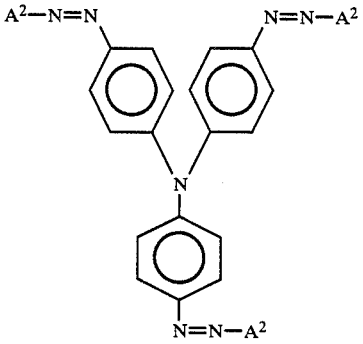
(IV)

wherein $A^2$ represents a moiety selected from the group consisting of:

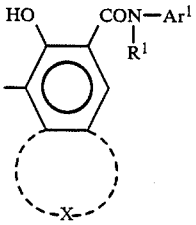
(A-1)

-continued

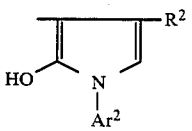
(A-2)

wherein X, $Ar^1$, $Ar^2$, $R^1$, and $R^2$ are respectively the same as those defined in the formulas (A-1) through (A-3).

2. The electrophotographic photoconductor as claimed in claim 1, wherein said charge generating azo pigment is an azo pigment having formula (I):

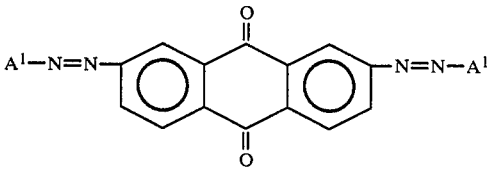
(I)

wherein $A^1$ represents a moiety selected from the group consisting of:

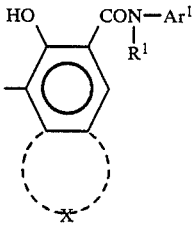
(A-1)

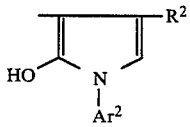
(A-2)

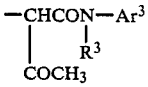
(A-3)

wherein X represents a member selected from the group consisting of a benzene ring, a naphthalene ring, an indole ring, a carbazole ring and a benzofuran ring, each of which may hav a substituent, $Ar^1$ represents a member selected from the group consisting of a benzene ring, a naphthalene ring, a dibenzofuran ring, each of which may have a substituent, $Ar^2$ and $Ar^3$ each represent a member selected from the group consisting of a benzene ring and a naphthalene ring, which may have a substituent, $R^1$ and $R^3$ each represent a member selected from the group consisting of hydrogen, an alkyl group having 1 to 4 carbon atoms, which may have a substituent, and a phenyl group which may have a substituent, and $R^2$ represents a member selected from the group consisting of an alkyl group having 1 to 4 carbon atoms, a phenyl group which may have a substituent, and a carboxyl group or an ester group thereof.

3. The electrophotographic photoconductor as claimed in claim 1, wherein said charge generating azo pigment is an azo pigment having formula (II):

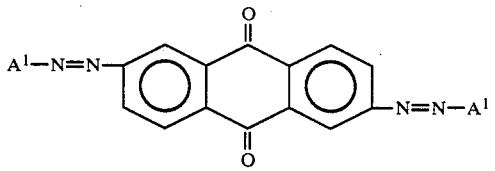

(II)

wherein $A^1$ represents a moiety selected from the group consisting of:

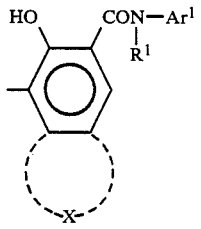

(A-1)

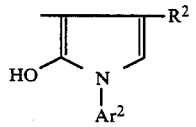

(A-2)

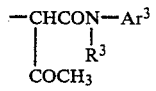

(A-3)

wherein X represents a member selected from the group consisting of a benzene ring, a naphthalene ring, an indole ring, a carbazole ring and a benzofuran ring, each of which may have a substituent, $Ar^1$ represents a member selected from the group consisting of a benzene ring, a naphthalene ring, a dibenzofuran ring, each of which may have a substituent, $Ar^2$ and $Ar^3$ each represent a member selected from the group consisting of a benzene ring and a naphthalene ring, which may have a substituent, $R^1$ and $R^3$ each represent a member selected from the group consisting of hydrogen, an alkyl group having 1 to 4 carbon atoms, which may have a substituent, and a phenyl group which may have a substituent, and $R^2$ represents a member selected from the group consisting of an alkyl group having 1 to 4 carbon atoms, a phenyl group which may have a substituent, and a carboxyl group or an ester group thereof.

4. The electrophotographic photoconductor as claimed in claim 1, wherein said charge generating azo pigment is an azo pigment having formula (III):

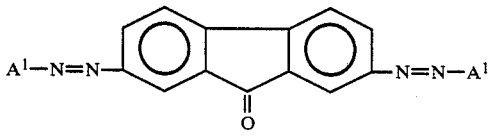

(III)

wherein $A^1$ represents a moiety selected from the group consisting of:

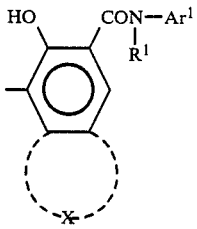

(A-1)

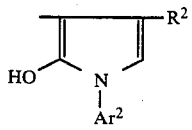

(A-2)

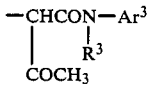

(A-3)

wherein X represents a member selected from the group consisting of a benzene ring, a naphthalene ring, an indole ring, a carbazole ring and a benzofuran ring, each of which may have a substituent, $Ar^1$ represents a member selected from the group consisting of a benzene ring, a naphthalene ring, a dibenzofuran ring, each of which may have a substituent, $Ar^2$ and $Ar^3$ each represent a member selected from the group consisting of a benzene ring and a naphthalene ring, which may have a substituent, $R^1$ and $R^3$ each represent a member selected from the group consisting of hydrogen, an alkyl group having 1 to 4 carbon atoms, which may have a substituent, and a phenyl group which may have a substituent, and $R^2$ represents a member selected from the group consisting of an alkyl group having 1 to 4 carbon atoms, a phenyl group which may have a substituent, and a carboxyl group or an ester group thereof.

5. The electrophotographic photoconductor as claimed in claim 1, wherein said charge generating azo pigment is an azo pigment having formula (IV):

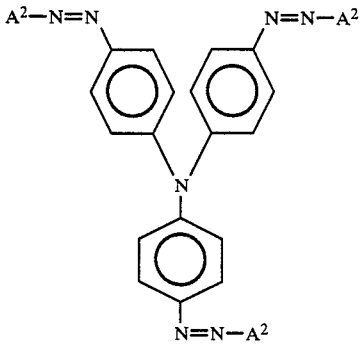

(IV)

wherein $A^2$ represents a moiety selected from the group consisting of:

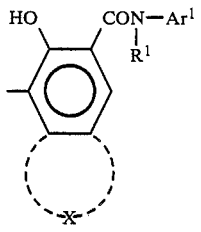

(A-1)

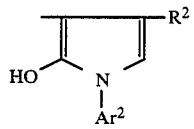

(A-2)

wherein X represents a member selected from the group consisting of a benzene ring, a naphthalene ring, an indole ring, a carbazole ring and a benzofuran ring, each of which may have a substituent, $Ar^1$ represents a member selected from the group consisting of a benzene ring, a naphthalene ring, a dibenzofuran ring, each of which may have a substituent, $Ar^2$ represents a member selected from the group consisting of a benzene ring and a naphthalene ring, which may have a substituent, $R^1$ represents a member selected from the group consisting of hydrogen, an alkyl group having 1 to 4 carbon atoms, which may have a substituent, and a phenyl group which may have a substituent, and $R^2$ represents a member selected from the group consisting of an alkyl group having 1 to 4 carbon atoms, a phenyl group which may have a substituent, and a carboxyl group or an ester group thereof.

6. The electrophotographic photoconductor as claimed in claim 1, wherein the content of said charge generating azo pigment is in the range of 30 wt. % to 80 wt. % of the entire weight of said intermediate layer.

7. The electrophotographic photoconductor as claimed in claim 1, wherein said thermosetting resin is selected from the group consisting of polymers prepared by thermal polymerization of a compound having a plurality of active hydrogens and at least one compound selected from the group consisting of a compound having a plurality of isocyanate groups and a compound having a plurality of epoxy groups.

8. The electrophotographic photoconductor as claimed in claim 7, wherein said compound having a plurality of active hydrogens is selected from the group consisting of polyvinyl butyral, phenoxy resin, phenolic resin, polyamide, and hydroxymethyl methacrylate.

9. The electrophotographic photoconductor as claimed in claim 7, wherein said compound having a plurality of isocyanate groups is selected grom the group consisting of tolylene diisocyanate, hexamethylene diisocyanate, diphenylmethane diisocyanate, and polymers thereof.

10. The electrophotographic photoconductor as claimed in claim 7, wherein said compound having a plurality of epoxy groups is Bisphenol A type epoxy resin.

11. The electrophotographic photoconductor as claimed in claim 1, wherein the thickness of said intermediate layer is in the range of 0.1 μm to 10 μm.

12. The electrophotographic photoconductor as claimed in claim 1, wherein said charge generating material of said charge generating layer is selected from the group consising of a disazo pigment, a trisazo pigment, a pyerylene pigment, a squaric salt pigment, an azulenium salt dye and a quinone condensation polycyclic compound.

13. The electrophotographic photoconductor as claimed in claim 1, wherein said charge generating material of said charge generating layer is said charge generating azo pigment contained in said intermediate layer.

14. The electrophotographic photoconductor as claimed in claim 1, wherein the content of said charge generating in said charge generating layer is in the range of 30 wt. % to 90 wt. % of the entire weight of said charge generating layer.

15. The electrophotographic photoconductor as claimed in claim 1, wherein the thickness of said charge transporting layer is in the range of about 5 μm to about 30 μm.

* * * * *